US009009052B2

(12) United States Patent
Nakano et al.

(10) Patent No.: US 9,009,052 B2
(45) Date of Patent: Apr. 14, 2015

(54) SYSTEM AND METHOD FOR SINGING SYNTHESIS CAPABLE OF REFLECTING VOICE TIMBRE CHANGES

(75) Inventors: Tomoyasu Nakano, Ibaraki (JP); Masataka Goto, Ibaraki (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 320 days.

(21) Appl. No.: 13/810,758

(22) PCT Filed: Jul. 19, 2011

(86) PCT No.: PCT/JP2011/066383

§ 371 (c)(1),
(2), (4) Date: Feb. 25, 2013

(87) PCT Pub. No.: WO2012/011475

PCT Pub. Date: Jan. 26, 2012

(65) Prior Publication Data

US 2013/0151256 A1 Jun. 13, 2013

(30) Foreign Application Priority Data

Jul. 20, 2010 (JP) ..... 2010-163402

(51) Int. Cl.
*G10L 13/00* (2006.01)
*G10L 13/06* (2013.01)
*G10L 13/033* (2013.01)

(52) U.S. Cl.
CPC ..... *G10L 13/0335* (2013.01); *G10L 13/033* (2013.01)

(58) Field of Classification Search
None
See application file for complete search history.

(56) References Cited

U.S. PATENT DOCUMENTS 6,046,395 A * 4/2000 Gibson et al. ..... 84/603
6,304,846 B1 * 10/2001 George et al. ..... 704/270

(Continued)

FOREIGN PATENT DOCUMENTS

JP 05-027771 2/1993
JP 2002-268658 9/2002

(Continued)

OTHER PUBLICATIONS

Kenmochi, H., et al; "Singing Synthesis System "VOCALOID" Current situation and todo lists", Information Processing Society of Japan (IPSJ), The Special Interest Group Technical Report 2008, MUS-74-9, vol. 2008, No. 12, pp. 51-58 (2008) (discussed in specification).

(Continued)

*Primary Examiner* — Satwant Singh
(74) *Attorney, Agent, or Firm* — Rankin, Hill & Clark LLP

(57) ABSTRACT

Herein provided is a system for singing synthesis capable of reflecting not only pitch and dynamics changes but also timbre changes of a user's singing. A spectral transform surface generating section 119 temporally concatenates all the spectral transform curves estimated by a second spectral transform curve estimating section 117 to define a spectral transform surface. A synthesized audio signal generating section 121 generates a transform spectral envelope at each instant of time by scaling a reference spectral envelope based on the spectral transform surface. Then, the synthesized audio signal generating section 121 generates an audio signal of a synthesized singing voice reflecting timbre changes of an input singing voice, based on the transform spectral envelope and a fundamental frequency contained in a reference singing voice source data.

14 Claims, 26 Drawing Sheets

(56) References Cited

U.S. PATENT DOCUMENTS

| | | | | |
|---|---|---|---|---|
| 6,307,140 | B1 * | 10/2001 | Iwamoto | 84/622 |
| 6,336,092 | B1 * | 1/2002 | Gibson et al. | 704/268 |
| 6,424,944 | B1 * | 7/2002 | Hikawa | 84/622 |
| 7,173,178 | B2 * | 2/2007 | Kobayashi | 84/645 |
| 7,189,915 | B2 * | 3/2007 | Kobayashi | 84/645 |
| 7,241,947 | B2 * | 7/2007 | Kobayashi | 704/268 |
| 7,379,873 | B2 * | 5/2008 | Kemmochi | 704/269 |
| 2002/0184006 | A1 | 12/2002 | Yoshioka et al. | |
| 2004/0006472 | A1 | 1/2004 | Kemmochi | |
| 2006/0185504 | A1 | 8/2006 | Kobayashi | |

FOREIGN PATENT DOCUMENTS

| | | |
|---|---|---|
| JP | 2003-223178 | 8/2003 |
| JP | 2004-038071 | 2/2004 |
| JP | 2004-287099 | 10/2004 |
| JP | 2005-234337 | 9/2005 |
| JP | 2010-009034 | 1/2010 |

OTHER PUBLICATIONS

Kawahara, H., et al; "Proposal on a Morphing-based Singing Design Manipulation Interface and Its Preliminary Study", Trans. of Information Processing Society of Japan (IPSJ), vol. 48, No. 12, pp. 3637-3648 (2007) (discussed in specification).

Morise, M: "[e. morish]—Interface for mixing multiple singing voices" (2008) (discussed in specification).

Toda, T., et al.; "Voice Conversion Based on Maximum Likelihood Estimation of Spectral Parameter Trajectory", The Institute of Electrical and Electronics Engineers (IEEE), Trans. on Audio, Speech and Language Processing, vol. 15, No. 8, pp. 2222-2235 (2007) (discussed in specification).

Ohtani, Y., et al.; "Maximum Likelihood Voice Conversion Based on Gaussian Mixture Model with STRAIGHT Mixed Excitation", Trans. of The Institute of Electronics, Information and Communication Engineers (IEICE), vol. J91-D, No. 4, pp. 1082-1091 (2008) (discussed in specification).

Schroder, M.; "Emotional Speech Synthesis: A Review", Proc. Eurospeech 2001, pp. 561-564 (2001) (discussed in specification).

Iida, A., et al; "A Corpus-Based Speech Synthesis System with Emotion", Speech Communication, vol. 40, pp. 161-187 (2003) (discussed in specification).

Tsuzuki, R., et al; "Constructing Emotional Speech Synthesis with Limited Speech Database", Proc. of International Conference on Spoken Language Processing 2004, pp. 1185-1188 (2004) (discussed in specification).

Kawatsu, H., et al.; "Rules and Evaluation for Controlling the Fundamental Frequency Contours with Various Degrees of Emotion Based on a Model for the Process of Generation", Trans. of The Institute of Electronics, Information and Communication Engineers (IEICE), vol. J89-D, No. 8, pp. 1811-1819 (2006) (discussed in specification).

Moriyama, T., et al.; "A Synthesis Method of Emotional Speech Using Subspace Constraints in Prosody", Trans. of Information Processing Society of Japan (IPSJ), vol. 50, No. 3, pp. 1181-1191 (2009) (discussed in specification).

Turk, O., et al.; "A Comparison of Voice Conversion Methods for Transforming Voice Quality in Emotional Speech Synthesis", Proc. of Interspeech 2008, pp. 2282-2285 (2008) (discussed in specification).

Nose, T., et al.; "HMM-Based Style Control for Expressive Speech Synthesis with Arbitrary Speaker's Voice Using Model Adaptation", The Institute of Electronics, Information and Communication Engineers (IEICE) Trans. on Information and Systems, vol. E92-D, No. 3, pp. 489-497 (2009) (discussed in specification).

Inanoglu, Z., et al.; "Data-driven emotion conversion in spoken English", Speech Communication, vol. 51, pp. 268-283 (2009) (discussed in specification).

Takahashi, T., et al.; "Average Voice Synthesis Using Multiple Speech Morphing", Proc. of the 2006 Spring Meeting of the Acoustical Society of Japan, 1-4-9, pp. 229-230 (2006) (discussed in specification).

Kawamoto, S., et al.; "Voice Output System Considering Personal Voice for Instant Casting Movie", Trans. of Information Processing Society of Japan, vol. 51, No. 2, pp. 250-264 (2010) (discussed in specification).

Nakano, T., et al.; "VocalListener: An Automatic Parameter Estimation System for Singing Synthesis by Mimicking User's Singing", Information Processing Society of Japan (IPSJ), Special Interest Group on Music and Computer Technical Report 2008-MUS-75-9, vol. 2008, No. 12, pp. 51-58 (2008) (discussed in specification).

Nakano, T., et al.; "Vocalistener: A Singing-to-singing Synthesis System based on Iterative Parameter Estimation", Proc. of the 6th Soung and Music Computing Conference 2009, pp. 343-348 (2009) (discussed in specification).

Kawahara, H., et al.; "Restructuring Speech Representations Using a Pitch-adaptive Time-frequency smoothing and an Instantaneous-frequency-based FO Extraction: Possible Role of a Repetitive Structure in Sounds", Speech Communication, vol. 27, pp. 187-207 (1999) (discussed in specification).

Kawahara, H., et al.; "Aperiodicity Extraction and Control Using Mixed Mode Excitation and Group Delay Manipulation for a High Quality Speech Analysis, Modification and Synthesis System STRAIGHT", 2nd International Workshop of Models and Analysis of Vocal Emissions for Biomedical Applications (MAVEBA) 2001 (Firenze, Italy in 2001) (discussed in specification).

Nishida, M., et al.; "Speaker Recognition by Projecting to Speaker Space with Less Phonetic Information", Trans. of The Institute of Electronics, Information and Communication Engineers (IEICE), vol. J85-D2, No. 4, pp. 554-562 (2002) (discussed in specification).

Inoue, T., et al.; "Voice Conversion Using Subspace Method and Gaussian Mixture Model": Technical Report of The Institute of Electronics, Information and Communication Engineers (IEICE), vol. 101, No. 86, pp. 1-6 (2001) (discussed in specification).

Turk, G., et al.; "Modeling with Implicit Surfaces that Interpolate", ACM Transactions on Graphics, vol. 21, No. 4 pp. 855-873 (2002) (discussed in specification).

International Search Report filed in PCT/JP2011/066383.

* cited by examiner

*i*

SYSTEM AND METHOD FOR SINGING SYNTHESIS CAPABLE OF REFLECTING VOICE TIMBRE CHANGES

TECHNICAL FIELD

The present invention relates to a system for singing synthesis which is capable of generating a synthesized singing voice mimicking pitch, dynamics, and voice timbre changes of an input singing voice and a method thereof.

BACKGROUND ART

A singing synthesis system capable of artificially generating a singing voice like a human's can readily synthesize various sorts of singing voices and control singing representation with high reproducibility. Such systems have become an important tool for expanding a possibility of producing music accompanied by singing. Since 2007, a rapidly increasing number of end users have enjoyed producing music using commercially available singing synthesis software. Increased use of the commercially available singing synthesis software is of public concern, and such singing synthesis systems have become a hot topic for discussion over various media.

Singing synthesis technologies include manual adjustment of numeric parameters by a user with a mouse as described in non-patent document 1, voice morphing based on singing voices of the same lyrics sung by two singers as described in non-patent document 2, and emotional morphing applied to a plurality of singing songs sung by the same singer with emotional changes as described in non-patent document 3. Speech synthesis technologies include voice conversion between different speakers as described in non-patent documents 4 and 5, and emotional voice synthesis as described in non-documents 6 and 7. Most of emotional voice synthesis techniques deal with speech rhythm and speed, but some of them are focused on the use of voice conversion in accompaniment with emotional changes as shown in non-patent documents to 13. Further, there have been some studies on speech morphing such as a study on average voice generation from a plurality of voices as described in non-patent document 14 and a study on voice morphing close to a user's voice by estimating a ratio of a plurality of voices as described in non-patent document 15.

In contrast therewith, the inventors of the present invention proposed "a system for estimating singing synthesis parameter data" in JP2010-9034A (patent document 1) which is a system capable of receiving a user's singing voice as an input and adjusting synthesis parameters of existing singing synthesis software so as to mimic the pitch and dynamics of the input singing voice. The inventors developed a singing synthesis system named "VocaListner" (a trademark) as an implementation of the proposed system. Refer to non-patent documents 16 and 17.

RELATED ART DOCUMENTS

Patent Documents

Patent Document 1: JP2010-9034A

Non-Patent Documents

Non-patent Document 1: KENMOCHI Hideki and OHSHITA Hayato, "Singing synthesis system 'VOCALOID' Current situation and todo lists", IPSJ-SIGMUS Report, 2008-MUS-74-9, Vol. 2008, No. 12, pp. 51-58 (2008).

Non-patent Document 2: KAWAHARA Hideki, IKOMA Taichi, MORISE Masanori, TAKAHASHI Toru, TOYODA Kenichi, and KATAYOSE Haruhiro, "Proposal on a Morphing-based Design Manipulation Interface and Its Preliminary Study", IPSJ Journal, Vol. 48, No. 12, pp. 3637-3648, (2007).

Non-patent Document 3: MORISE Masanori, "An interface for mixing singing voices <e.morish>", (refer to the following URL—http://www.crestmuse.jp/cmstraight/personal/e.morish/.

Non-patent Document 4: Toda, T., Black, A. and Tokuda, K., "Voice conversion based on maximum likelihood estimation of spectral parameter trajectory", IEEE Trans. on Audio, Speech and Language Processing, Vol. 15, No. 8, pp. 2222-2235 (2007).

Non-patent Document 5: OHTANI Yamato, TODA Tomoki, SARUWATARI Hiroshi, and SHIKANO Kiyohiro, "Maximum Likelihood Voice Conversion Based on Gaussian Mixture Model with STRAIGHT Mixed Excitation", IEICE Trans. on information and systems, Vo. J91-D, No. 4, pp. 1082-1091 (2008).

Non-patent Document 6: Schröder, M., "Emotional Speech Synthesis: A review", Proc. Eurospeech 2001, pp. 561-564 (2001).

Non-patent Document 7: Iida, A., Campbell, N., Higuchi, F. and Yasumura, N., "A corpus-based speech synthesis system with emotion", Speech Communication, Vol. 40, Iss. 1-2, pp. 161-187 (2003).

Non-patent Document 8: Tsuzuki, R., Zen, H., Tokuda, K., Kitamura, T. Bulut, M. and Narayanan, S. S., "Constructing emotional speech synthesizers with limited speech database", Proc. ICSLP 2004, pp. 1185-1188 (2004).

Non-patent Document 9: KAWATSU Hiromi, NAGASHIMA Daisuke, and OHNO Sumio, "Rules and Evaluation for Controlling the Fundamental Frequency Contours with Various Degrees of Emotion Based on a Model for the Process of Generation", IEICE Trans. on Information and Systems, Vo. J89-D, No. 8, pp. 1811-1819 (2006).

Non-patent Document 10: MORIYAMA Tsuyoshi, MORI Shinya, and OZAWA Shinji, "A Synthesis Method of Emotional Speech Using Subspace Constraints in Prosody", IPSJ Journal, Vol. 50, No. 3, pp. 1181-1191 (2009).

Non-patent Document 11: Türk, O., and Schröder, M., "A comparison of voice conversion methods for transforming voice quality in emotional speech synthesis", Proc. Interspeech 2008, pp. 2282-2285 (2008).

Non-patent Document 12: Nose, T., Tachibana, M. and Kobayashi, T., "HMM-based style control for expressive speech synthesis with arbitrary speaker's voice using model adaptation", IEICE Trans. on Information and Systems, Vol. E92-D, No. 3, pp. 489-497 (2009).

Non-patent Document 13: Inanoglua, Z. and Young, S., "Data-driven emotion conversion in spoken English", Speech Communication, Vol. 51, Is. 3, pp. 268-283 (2009).

Non-patent Document 14: TAKAHASHI Toru, NISHI Masashi, IRINO Toshio, and KAWAHARA Hideki, "Average voice synthesis based on multiple voice morphing", Proc. of AST Spring Workshop, 1-4-9, pp. 229-230 (2006).

Non-patent Document 15: KAWAMOTO Shinichi, ADACHI Yoshihiro, OHTANI Yamato, YOTSUKURA Tatsuo, MORISHIMA Shigeo, and NAKAMURA Satoshi, "Voice Output System Considering Personal Voice for instant Casting Movie", IPSJ Journal, Vol. 51, No. 2, pp. 250-264 (2010).

Non-patent Document 16: NAKANO Tomoyasu and GOTO Masataka, "VocaListener: An Automatic Parameter Estimation System for Singing Synthesis by Mimicking User's Singing", IPSJ-SIGMUS Report, 2008-MUS-75-9, Vol. 2008, No. 12, pp. 51-58 (2008).

Non-patent Document 17: Nakano, T. and Goto, M., "VocaListner: A Singing-TO-Singing Synthesis System Based on Iterative Parameter Estimation", Proc. SMC 2009, pp. 343-348 (2009).

SUMMARY OF INVENTION

Technical Problem

The existing techniques as described in patent document 1 and non-patent documents 16 and 17 are intended to estimate singing synthesis parameters for existing singing synthesis software by mimicking the pitch and dynamics of a user's singing (refer to FIG. 1). Thanks to these techniques, estimation accuracy has increased due to iterative estimation of the parameters, and automatic synthesis has become possible without re-adjustment even if a singing synthesis system or a singing voice source (a singer database) is changed. Alignment of musical notes with lyrics are substantially automatically done simply by inputting text of a song's lyrics with a unique phone model dedicated for singing voice. Synthesized singing voices resulting from the above-mentioned techniques can be listened at http://staff.aist.go.jp/t.nakano/VocaListner/index-j.html.

The techniques as described in patent document 1 and non-patent documents 16 and 17 can only reflect pitch and dynamics changes in synthesized singing, and cannot fully represent the emotions and singing style of a user's singing as well as voice timbre changes. The term "voice quality" is used in many different senses. The term refers not only to acoustic features and auditory differences that can identify an individual singer, but also to differences in voice due to utterance styles such as growling and whispering and auditory impressions such as light or dark voice representation. The term "voice timbre changes" is used herein to mean changes in voice timbre of singing, as discriminated from the term "voice quality". Refection of voice timbre changes in synthesized singing in accompaniment with the lyrics and melody by mimicking voice timbre changes in the user's singing will lead to more attractive singing synthesis.

There is a known singing synthesis system called "VocaLoid (a trademark)" capable of allowing the user to explicitly deal with voice timbre changes as disclosed in non-patent document 1. The technique disclosed in non-patent document 1 can synthesize singing reflecting voice timbre changes by adjusting a plurality of numeric parameters at each instant of time to manipulate the spectrum of singing voice. With this technique, however, it is difficult to manipulate the parameters in concert with the music. Most of the users do not manipulate the parameters. Or they changes parameters all together for each piece of music or roughly change the parameters.

An object of the present invention is to provide a system and a method for singing synthesis reflecting voice timbre changes that is capable of reflecting not only pitch and dynamics changes but also voice timbre changes of a user's singing.

Solution to Problem

Basically, the present invention employs the technique disclosed in patent document 1 and non-patent documents 16 and 17 to synthesize diversified singing voices by mimicking the pitch and dynamics of an input singing voice sung by a user and using the same lyrics of the input singing. Then, the present invention constructs a subspace called a voice timbre space to represent components contributing to voice timbre changes from the input and synthesized singing voices. Finally, a singing voice is synthesized to reflect the voice timbre changes of the user's singing voice in the subspace.

A system for singing synthesis capable of reflecting voice timbre changes according to the present invention includes a system for singing synthesis reflecting pitch and dynamics changes, a synthesized singing voice audio signal storing section, a spectral envelope estimating section, a voice timbre space estimating section, a trajectory shifting and scaling section, a first spectral transform curve estimating section, a second spectral transform curve estimating section, a spectral transform surface generating section, and a synthesized audio signal generating section.

The system for singing synthesis reflecting pitch and dynamics changes is configured to synthesize a variety of singing voices by mimicking the pitch and dynamics of an input singing voice with the same lyrics as the input singing voice. The system includes an audio signal storing section operable to store the input singing voice, a singing voice source database, a singing voice synthesis parameter data estimating section, a singing voice synthesis parameter data storing section, a lyrics data storing section, and a singing voice synthesizing section. As the system for singing synthesis reflecting pitch and dynamics changes, for example, systems disclosed in patent document 1 and non-patent documents 16 and 17 may be used. The input singing voice audio signal storing section is operable to store an audio signal of a user's singing voice. The singing voice source database accumulates singing voice source data on K sorts of different singing voices where K is an integer one or more and singing voice source data on J sorts of singing voices of the same singer with J sorts of voice timbres where J is an integer of two or more. The singing voice source data on J sorts of singing voices of the same singer with J sorts of voice timbres are readily available from existing singing synthesis systems capable of implementing voice timbre changes.

The singing synthesis parameter data estimating section is operable to estimate singing synthesis parameter data representing the audio signal of the input singing voice with a plurality of parameters including at least a pitch parameter and a dynamics parameter. The singing synthesis parameter data storing section is operable to store the singing synthesis parameter data. The lyrics data storing section is operable to store lyrics data corresponding to the audio signal of the input singing voice. The singing voice synthesizing section is operable to output an audio signal of a synthesized singing voice, based on at least the singing voice source data on one sort of singing voice selected from the singing voice source database, the singing synthesis parameter data, and the lyrics data. The pitch parameter is arbitrary, provided that it can indicate pitch changes. The dynamics parameter is arbitrary, provided that it can indicate dynamics changes. For example, the dynamics parameter is an expression according to the MIDI standard, or dynamics (DYN) of a commercially available singing synthesis system.

The synthesized singing voice audio signal storing section is operable to store audio signals of K sorts of different time-synchronized synthesized singing voices and audio signals of J sorts of time-synchronized synthesized singing voices of the same singer with different voice timbres. These singing voices have been produced by the system for singing synthesis reflecting pitch and dynamics changes.

The spectral envelope estimating section is operable to apply frequency analysis to the audio signal of the input singing voice and the audio signals of K+J sorts of synthesized singing voices, and estimate S spectral envelopes with influence of pitch ($F_0$) removed, based on results of the frequency analysis of these audio signals. Here, S=K+J+1. The inventors have found that the difference in voice timbre can be defined as the difference in spectral envelope shape as a result of the frequency analysis of the audio signal. The difference in spectral envelope shape includes differences in phoneme and a singer's individuality. Therefore, voice timbre changes may be defined as temporal changes in spectral envelope shape as a result of the frequency analysis of the audio signal with the influence of phonemes and individuality being suppressed. In the present invention, the voice timbre estimating section and the trajectory shifting and scaling section are provided to suppress the differences in phoneme and individuality.

The voice timbre space estimating section is operable to suppress components other than components contributing to voice timbre changes from a time sequence of the S spectral envelopes by means of processing based on a subspace method, and estimate an M-dimensional voice timbre space reflecting voice timbres of the input singing voice and the J sorts of voice timbres where M is an integer of one or more. The voice timbre space is a virtual space in which components other than timbre changes are suppressed. S audio signals correspond to or are positioned at one point in the voice timbre space at each instant of time. In the voice timbre space, temporal changes of the S audio signals can be represented as a trajectory which temporally changes.

The trajectory shifting and scaling section is operable to estimate a positional relationship of the J sorts of voice timbres at each instant of time with M-dimensional vectors in the voice timbre space, based on the J spectral envelopes for the audio signals of the J sorts of different singing voices synthesized from the same singer's voice with different voice timbres. Prior to this, the J sorts of voice timbres at each instant of time have been obtained by suppressing the components other than the components contributing to the voice timbre changes by means of the processing based on the subspace method. The trajectory shifting and scaling section is also operable to estimate a time trajectory of the positional relationship of the voice timbres estimated with the M-dimensional vectors as a timbre change tube in the voice timbre space. The term "timbre change tub" refers to a polytope encompassing J positions in the voice timbre space in respect of the J sorts of voice timbres of J sorts of time-synchronized synthesized singing voices of the same singer. A temporal trajectory of the polytope is assumed. Further, the trajectory shifting and scaling section is operable to estimate a positional relationship of the voice timbres of the input singing voice at each instant of time with M-dimensional vectors in the voice timbre space, from the spectral envelope for the audio signal of the input singing voice. Prior to this, the voice timbres of the input singing voice at each instant of time have been obtained by suppressing the components other than the components contributing to the voice timbre changes by means of the processing based on the subspace method. The trajectory shifting and scaling section is also operable to estimate a time trajectory of the positional relationship of the voice timbres of the input singing voice estimated with the M-dimensional vectors as a voice timbre trajectory of the input singing voice in the voice timbre space. Then, the trajectory shifting and scaling section is operable to shift or scale at least one of the voice timbre trajectory of the input singing voice and the timbre change tube such that the entirety or a major part of the voice timbre trajectory of the input singing voice is present inside the timbre change tube. In this manner, if the voice timbre space is assumed to be M-dimensional, it is assumed that J M-dimensional vectors for the target voice timbres exist in the M-dimensional space at each instant of time t. The inside defined as being encompassed by J points in the M-dimensional space is assumed to be a transposable area of the target input singing voice of the same singer. Namely, the polytope or an M-dimensional polytope changing from moment to moment is an area allowing timbre changes. Therefore, a target position for singing synthesis in the voice timbre space at each instant of time is determined by shifting and scaling the voice timbre trajectory of the input singing voice existing in a different position in the voice timbre space such that the trajectory is present inside the timbre change tube as much as possible. In other words, this is done by expanding or reducing at least one of the voice timbre trajectory and the timbre change tube without changing the time axis, and shifting the position. Then, a transformed spectral envelope is generated for a synthesized singing voice reflecting voice timbre changes, based on the target position thus determined for singing synthesis.

In the present invention, spectral envelopes are not used as they are. The first spectral transform curve estimating section is operable to estimate J spectral transform curves for singing synthesis in correspondence with the J sorts of voice timbres as follows. The first spectral transform curve estimating section defines one of the J sorts of singing voice source data as reference singing voice source data, and defines the spectral envelope for an audio signal of the synthesized singing voice corresponding to the reference singing voice source data as a reference spectral envelope. Then, the first spectral transform curve estimating section calculates, at each instant of time, transform ratios of the J spectral envelopes for the audio signals of the J sorts of synthesized singing voices over the reference spectral envelope. The spectral transform curve for singing synthesis indicates changes in transform ratios obtained at each instant of time. The second spectral transform curve estimating section is operable to estimate a spectral transform curve corresponding to the voice timbre trajectory of the input singing voice at each instant of time so as to satisfy a the following constraint: when one point of the voice timbre trajectory of the input singing voice determined by the trajectory shifting and scaling section overlaps a certain voice timbre inside the timbre change tube at a certain instant of time, a spectral envelope for an audio signal of the input singing voice at the certain instant of time should coincide with the spectral envelope of the synthesized singing voice having the overlapped voice timbre. The spectral transform curve is intended to mimic voice timbres of the input singing voice in the voice timbre space.

The spectral transform surface generating section is operable to define a spectral transform surface at each instant of time by temporally concatenating all the spectral transform curves estimated by the second spectral transform curve estimating section. The synthesized audio signal generating section is operable to generate a transform spectral envelope at each instant of time by scaling the reference spectral envelope based on the spectral transform surface, and generate an audio signal of a synthesized singing voice reflecting voice timbre changes of the input singing voice, based on the transform spectral envelope and a fundamental frequency ($F_0$) contained in the reference singing voice source data. Singing synthesis capable of mimicking voice timbre changes of the input singing voice can be implemented in such a configuration as described so far.

Specifically, the spectral envelope estimating section normalizes dynamics of S audio signals comprised of the audio signal of input singing voice, the audio signals of J sorts of synthesized singing voices, and the audio signals of the K sorts of synthesized singing voices. The spectral envelope estimating section applies frequency analysis to the S normalized audio signals, and estimate a plurality of pitches and non-periodic components for a plurality of frequency spectra based on results of the frequency analysis. The spectral envelope estimating section determines whether a frame is voiced unvoiced by comparing the estimated pitch with a threshold of periodicity score. For the voiced frames, the spectral envelope estimating section estimates envelopes for the plurality of frequency spectra in an $L_1$ dimension based on fundamental frequencies of the audio signals. Here, $L_1$ is an integer of the power of 2 plus 1. For the unvoiced frames, the spectral envelope estimating section estimates envelopes for the plurality of frequency spectra in the $L_1$ dimension based on a predetermined low frequency. Finally, the spectral envelope estimating section estimates the S spectral envelopes based on the plurality of frequency spectral envelopes for the voiced frames and the plurality of frequency spectral envelopes for the unvoiced frames. If the spectral envelope estimating section is configured in this manner, it is possible to estimate spectral envelopes with the influence of $F_0$ removed for voiced frames. It is also possible to estimate spectral envelopes appropriately representing the frequency transfer characteristics for unvoiced frames. As a result, high quality singing synthesis can be obtained by using non-periodic components in synthesis.

Specifically, the voice timbre space estimating section applies discrete cosine transform to the S spectral envelopes to obtain S discrete cosine transform coefficients, and obtain S discrete cosine transform coefficient vectors up to low $L_2$ dimensions as targets of analysis in respect of the S spectral envelopes. Here, $L_2$ is a positive integer of $L_2<L_1$ and the low $L_2$ dimensions excludes 0-dimension which is a DC component of the discrete cosine transform coefficient. The voice timbre space estimating section applies principal component analysis to the S $L_2$-dimensional discrete cosine transform coefficient vectors in each of T frames in which the S audio signals are voiced at the same instant of time to obtain principal component coefficients and a cumulative contribution ratio for each of the S $L_2$-dimensional discrete cosine transform coefficient vectors. Here, T is the number of seconds of duration of the audio signal×(multiplied by) sampling period at a maximum. The number of seconds of duration of the audio signal refers to the length of the target audio signal as measured in seconds. Then, the voice timbre space estimating section converts the S discrete cosine transform coefficients into S $L_2$-dimensional principal component scores in the T frames by using the principal component coefficients. Next, the voice timbre space estimating section obtains S N-dimensional principal component scores in respect of the S $L_2$-dimensional principal component scores by setting zero to principal component scores in dimensions higher than the low N-dimension in which a cumulative contribution ratio becomes R %. Here, $0<R<100$ and N is an integer of $1\leq N\leq L_2$ as determined by R. Further, the voice timbre space estimating section applies inverse transform to the S N-dimensional principal component scores to convert the scores into S new $L_2$-dimensional discrete cosine transform coefficients by using the corresponding principal component coefficients. Then, the voice timbre space estimating section applies principal component analysis to T×S new $L_2$-dimensional discrete cosine transform coefficient vectors to obtain principal component coefficients and a cumulative contribution ratio for each of the T×S new $L_2$-dimensional discrete cosine transform coefficient vectors. Finally, the voice timbre space estimating section converts the $L_2$-dimensional discrete cosine transform coefficients into principal component scores by using the thus obtained principal component coefficients, and defines a space represented by the principal component scores up to M lowest dimensions as the voice timbre space. Here, $1\leq M\leq L_2$. If the voice timbre space is defined using the discrete cosine transform in this manner, it is possible to efficiently reduce the number of dimensions since power concentrates on the low dimensions and can be treated with a real number as compared with when the Fourier transform is used.

Specifically, the trajectory shifting and scaling section shifts and scales T×J M-dimensional principal component score vectors for the audio signals of the J sorts of synthesized singing voices such that the vectors are in the range of 0 to 1 in each dimension. Here, the T×J M-dimensional principal component score vectors form the timbre change tube. The trajectory shifting and scaling section also shifts and scales T M-dimensional principal component score vectors for the audio signal of the input singing voice such that the vectors are in the range of 0 to 1 in each dimension. Here, the T M-dimensional principal component score vectors form the voice timbre trajectory of the input singing voice. Thus, the entirety or a major part of the voice timbre trajectory of the input singing voice is placed inside the timber change tube. The entirety or a major part of the voice timbre trajectory of the input singing voice can be placed inside the timbre change tube by shifting and scaling such that the vectors fall within the range of 0 to 1 in each dimension.

Preferably, the second spectral transform curve estimating section has a function of thresholding the spectral transform curves at each instant of time corresponding to the voice timbre trajectory of the input singing voice by defining upper and lower limits for the spectral transform curves. If the voice timbre trajectory of the input singing voice is far apart from the timbre change tube, unnatural transformation of the voice timbre trajectory of the input singing voice can be alleviated by thresholding the spectral transform curves with the upper and lower limits defined for the spectral transform curves.

Preferably, the spectral transform surface generating section applies two-dimensional smoothing to the spectral transform surface. With such two-dimensional smoothing, abrupt changes in spectral envelopes can be suppressed, thereby alleviating the unnaturalness of a synthesized singing voice.

A method for singing synthesis of the present invention is capable of reflecting voice timbre changes. In a synthesized singing voice audio signal generating step, audio signals for K sorts of different time-synchronized synthesized singing voices, and audio signals for the J sorts of time-synchronized synthesized singing voices of the same singer with different voice timbres are generated using the system for singing synthesis reflecting pitch and dynamics changes as described before. Here, K is an integer of one or more and J is an integer of two or more. Next in a spectral envelope estimating step, frequency analysis is applied to the audio signal of the input singing voice and the audio signals of K+J sorts of synthesized singing voices, and S spectral envelopes with influence of pitch ($F_0$) removed are estimated based on results of the frequency analysis of these audio signals. Here, S=K+J+1.

In a voice timbre space estimating step, components other than components contributing to voice timbre changes are suppressed from a time sequence of the S spectral envelopes by means of processing based on a subspace method; and an M-dimensional voice timbre space reflecting voice timbres of the input singing voice and the J sorts of voice timbres is estimated. Here, M is an integer of one or more. Next in a trajectory shifting and scaling step, a positional relationship of the J sorts of voice timbres at each instant of time is estimated from the J spectral envelopes for the audio signals of the J sorts of different singing voices synthesized from the same singer's voice having different voice timbres with M-dimensional vectors in the voice timbre space. Prior to this, the J sorts of voice timbres at each instant of time have been obtained by suppressing the components other than the components contributing to the voice timbre changes by means of the processing based on the subspace method. A time trajectory of the positional relationship of the voice timbres estimated with the M-dimensional vectors is estimated as a timbre change tube in the voice timbre space. In this step, a positional relationship of the voice timbres of the input singing voice at each instant of time is estimated from the spectral envelope for the audio signal of the input singing voice with M-dimensional vectors in the voice timbre space. Prior to this, the voice timbers have been obtained by suppressing the components other than the components contributing to the voice timbre changes by means of the processing based on the subspace method. Also in this step, a time trajectory of the positional relationship of the voice timbres of the input singing voice estimated with the M-dimensional vectors is estimated as a voice timbre trajectory of the input singing voice in the voice timbre space. Then, in this step, at least one of the voice timbre trajectory of the input singing voice and the timbre change tube is shifted and scaled such that the entirety or a major part of the voice timbre trajectory of the input singing voice is present inside the timbre change tube.

In a first spectral transform curve estimating step, J spectral transform curves for singing synthesis in correspondence with the J sorts of voice timbres are estimated as follows. One of the J sorts of singing voice source data is defined as reference singing voice source data; the spectral envelope for an audio signal of the synthesized singing voice corresponding to the reference singing voice source data is defined as a reference spectral envelope; and calculation is done at each instant of time to obtain transform ratios of the J spectral envelopes for the audio signals of the J sorts of synthesized singing voices over the reference spectral envelope. Then, in a second spectral transform curve estimating step, a spectral transform curve corresponding to the voice timbre trajectory of the input singing voice is estimated at each instant of time so as to satisfy the following constraint: when one point of the voice timbre trajectory of the input singing voice determined by the trajectory shifting and scaling section overlaps a certain voice timbre inside the timbre change tube at a certain instant of time, a spectral envelope for an audio signal of the input singing voice at the certain instant of time should coincide with the spectral envelope of the synthesized singing voice having the overlapped voice timbre.

In a spectral transform surface generating step, all the spectral transform curves are defined or referred as a spectral transform surface at each instant of time by temporally concatenating the spectral transform curves estimated in the second spectral transform curve estimating step.

In a synthesized audio signal generating step, a transform spectral envelope is generated at each instant of time by scaling the reference spectral envelope based on the spectral transform surface, and then an audio signal of a synthesized singing voice reflecting voice timbre changes of the input singing voice is generated based on the transform spectral envelope and a fundamental frequency ($F_0$) contained in the reference singing voice source data. In the present invention, all of the steps described so far are implemented in a computer.

DESCRIPTION OF EMBODIMENT

A method, as described in patent document 1 and non-patent documents 16 and 17, of automatically estimating voice quality parameters of existing singing synthesis systems in accordance with a user's singing can be considered as a solution to "mimicking as user's singing" in terms of voice timbre changes. Although this method is feasible, it is not practical and unfitted for general purpose use. Unlike the pitch and dynamics parameters, the parameters associated with the voice quality and voice timbre changes differ among the singing synthesis systems. From this, it can reasonably be considered that the acoustic features affected by the voice quality and voice timbre changes parameters differ for each singing synthesis system. In fact, some of the parameters to be manipulated in the system disclosed in patent document 1 differ from those of the embodiment of the other conventional system. Assuming that an optimal method for each voice quality parameter is established, there is still possibility that such parameter may not be applicable to a particular singing synthesis system, and it is not versatile. In contrast, an applied product of Crypton Future Media, Inc. called "Hatsune Miku Append (MIKU Append; a trademark)" can synthesize singing voices with six sorts of voice timbres, DARK, LIGHT, SOFT, SOLID, SWEET, AND VIVID using a voice of Hatsune Miku, a virtual character as synthesized by another applied product called "Hatsune Miku (a trademark)" of Crypton Future Media, Inc. It is possible to synthesize singing by switching the voice sources for each lyric phrase, but hard to produce intermediate voices in the singing synthesis system. For example, it is hard to smooth such voice timbre changes that singing starts with an intermediate voice of "LIGHT and SOLID" and then gradually switches to the ordinary voice timbre of Hatsune Miku. To solve this problem, it is not sufficient to simply manipulate the parameters provided in the singing synthesis system, but external signal processing is required. In the present invention, voice timbre changes are reflected by means of signal processing using synthesized singing voices which have been synthesized by mimicking the pitch and dynamics of the user's singing.

It is necessary to solve the problem of "mimicking voice timbre changes" in order to implement singing synthesis reflecting timber changes of the user's singing. Specifically, the following two problems should be solved.

Problem (1): How to represent voice timbre changes

Problem (2): How to reflect voice timbre changes of the user's singing

Figure 1A:
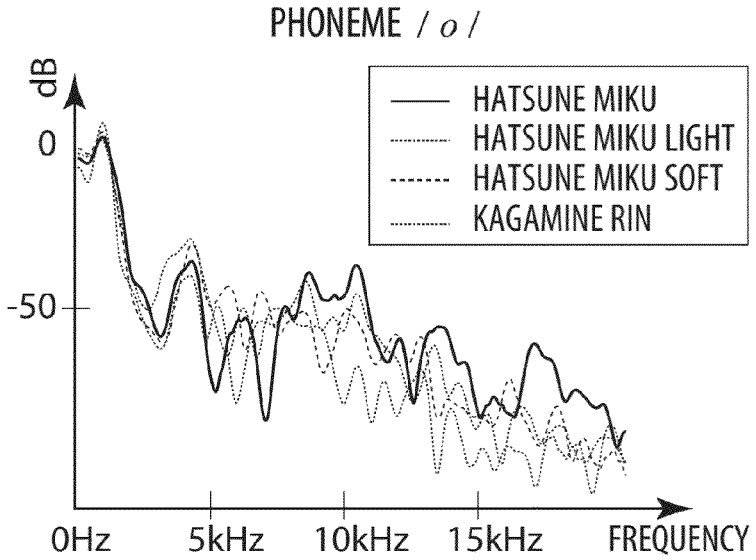
FIGS. 1A and 1B are used to explain that differences in voice timbre can be defined as differences in spectral envelope.
Figure 1B:
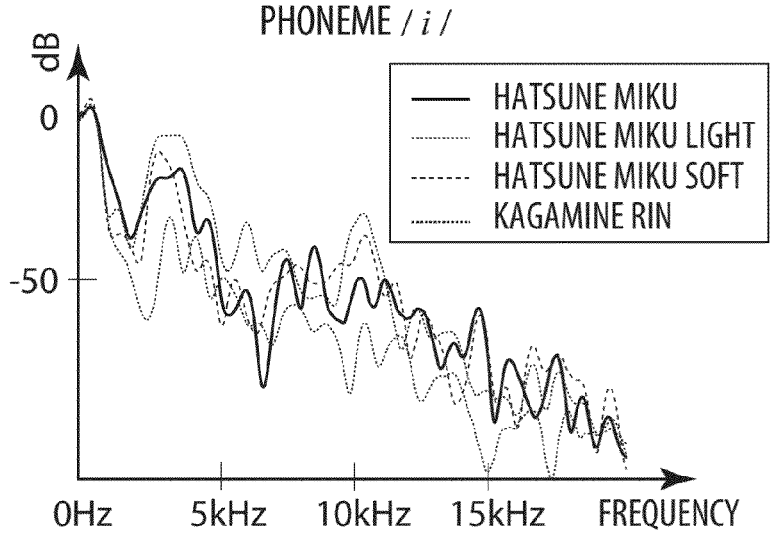

Here, differences in voice timbre correspond to differences in synthesized singing obtained from the applied products "Hatsune Miku" and "Hatsune Miku Append". The differences in voice timbre can be defined as differences in spectral envelope shape. As shown in FIGS. 1A and 1B, the differences in spectral envelope shape includes differences in phoneme and a singer's individuality. Temporal changes with such phoneme and individuality components suppressed can be considered as voice timbre changes. If a time sequence of the spectral envelope reflecting the voice timbre changes can be generated, it will be possible to implement singing synthesis reflecting voice timbre changes of the user's singing.

Figure 2:
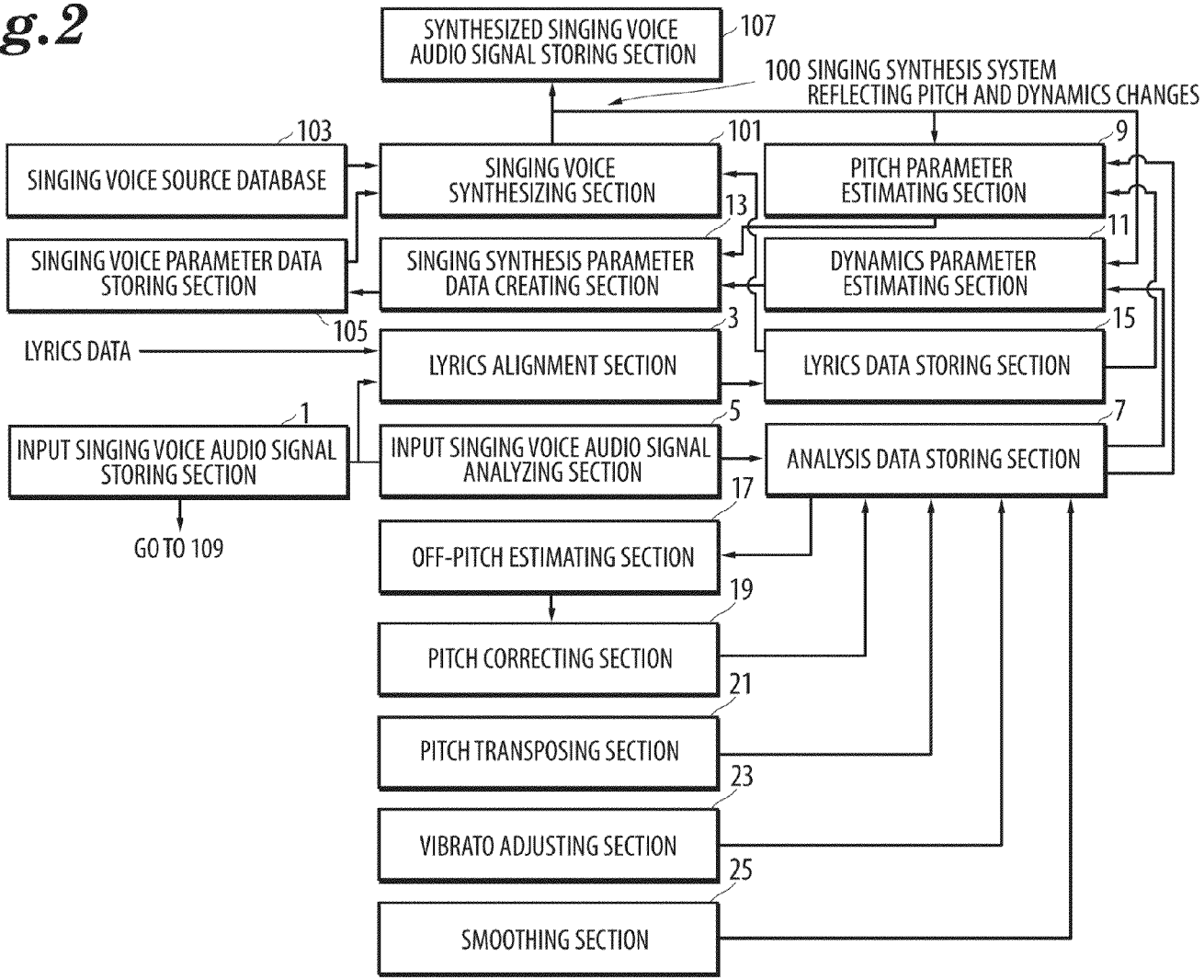
FIG. 2 is a block diagram showing an example configuration of the system for singing synthesis reflecting pitch and dynamics changes used in an embodiment of the present invention.
Figure 3:
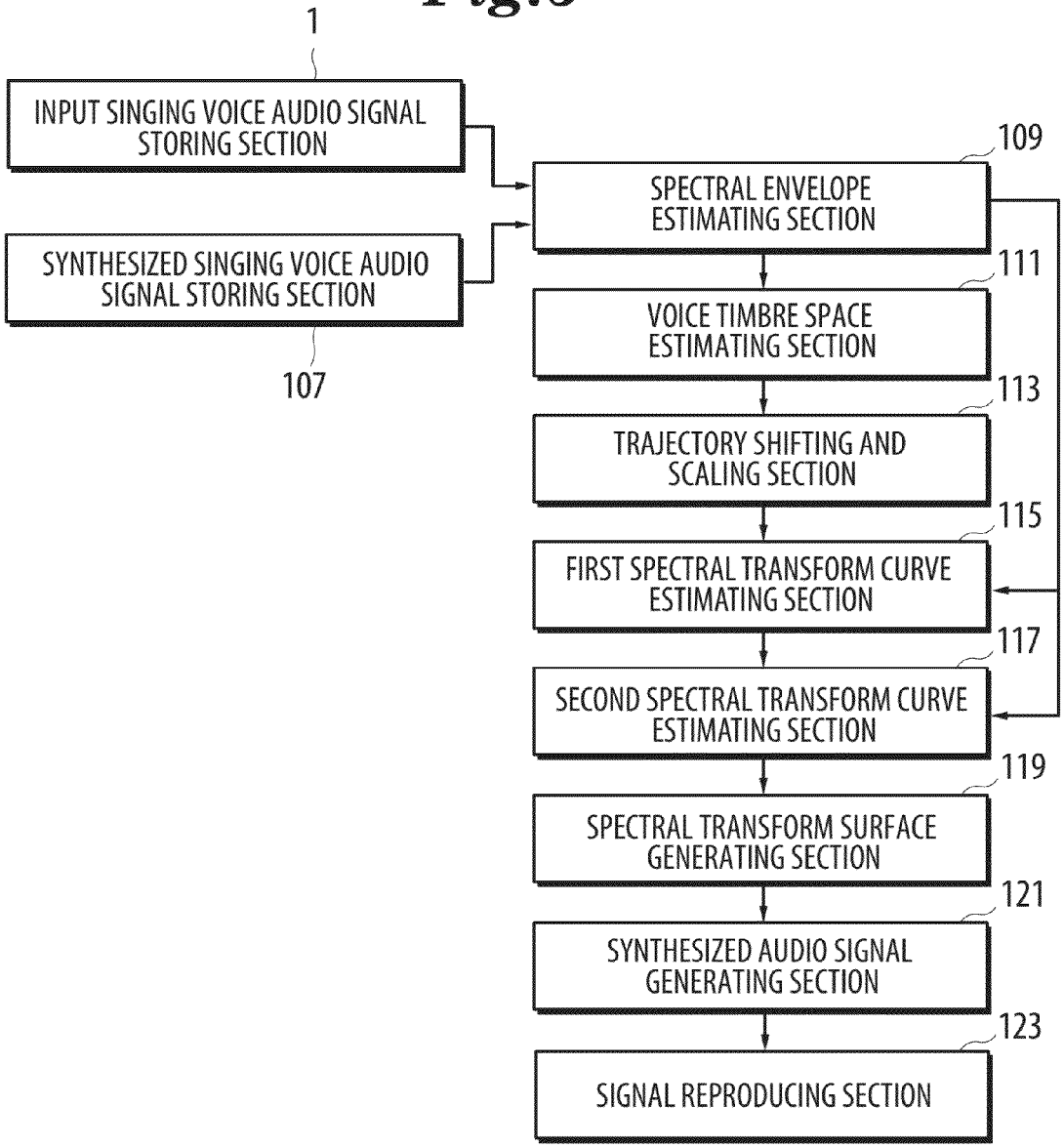
FIG. 3 is a block diagram showing a major part of an example configuration of the system for singing synthesis reflecting voice timbre changes in the embodiment of the present invention.
Figure 4:
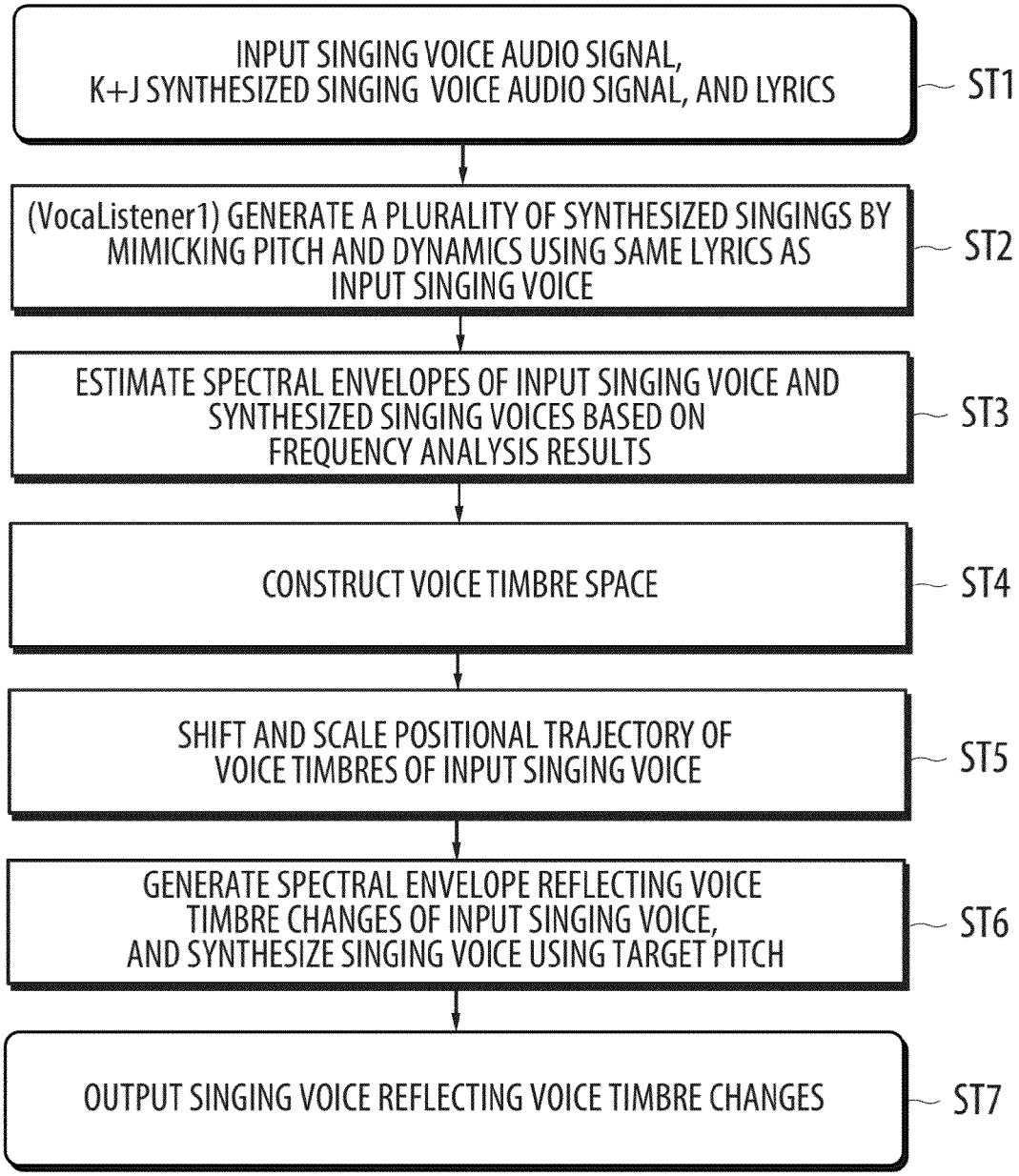
FIG. 4 is a flowchart showing a main algorithm to implement the system and method for singing synthesis reflecting voice timbre changes of the present invention using a computer.

Now, an embodiment of the system for singing synthesis capable of reflecting voice timbre changes according to the present invention will be described. In the embodiment, the above-mentioned two problems are solved. FIG. 2 is a block diagram showing an example configuration of the system 100 for singing synthesis reflecting pitch and dynamics changes used in an embodiment of the present invention. FIG. 3 is a block diagram showing a major part of an example configuration of the system for singing synthesis reflecting voice timbre changes in the embodiment of the present invention. FIG. 4 is a flowchart showing a main algorithm to implement the system and method for singing synthesis capable of reflecting voice timbre changes of the present invention using a computer.

The system 100 for singing synthesis reflecting pitch and dynamics changes shown in FIG. 2 iteratively updates singing synthesis parameter data by comparing a synthesized singing voice (an audio signal of the synthesized singing voice) with an input singing voice (an audio signal of the input singing voice). Hereinafter, an audio signal of singing given by the user is referred to as an input singing voice audio signal, and an audio signal of synthesized singing produced by the singing voice synthesizing section is referred to as a synthesized singing voice audio signal. In the embodiment of the present invention, the user is assumed to input an input singing voice audio signal and a song's lyrics data to the system (see step ST1 in FIG. 4). As described later, singing voice source data on K sorts of different voices and singing voice source data on J sorts of singing voices of the same singer having J sorts of voice timbres are also input to the system. Note that K denotes an integer of one or more and J denotes an integer of two or more.

The input singing audio signal is stored in the audio signal storing section 1. The input singing audio signal may be an audio signal of the user's singing voice input from a microphone or the like, or an audio signal of an existing singer's voice, or an audio signal output from an arbitrary singing synthesis system. The lyrics data may generally contain mixed text of Kanji and Kana characters if the lyrics are written in Japanese. The lyrics data contain alphabetic text if the lyrics are written in English. The lyrics data are input to a lyrics alignment section 3 as described later. An input singing voice audio signal analyzing section 5 analyzes the input singing voice audio signal. The lyrics alignment section 3 converts the input lyrics data into data in which syllabic boundaries are identified such that the lyrics are synchronized with the input singing voice audio signal. Then, the lyrics alignment section 3 stores conversion results in the lyrics data storing section 15. For the lyrics written in Japanese, the lyrics alignment section 3 allows the user to manually correct errors of converting mixed text of Kanji and Kana characters into Kana strings. Further, the lyrics alignment section 3 allows the user to manually correct significant error extending over phrases in lyrics alignment. The lyrics data with syllabic boundaries identified are directly input to the lyrics data storing section 15.

Figures 5A, 5B:
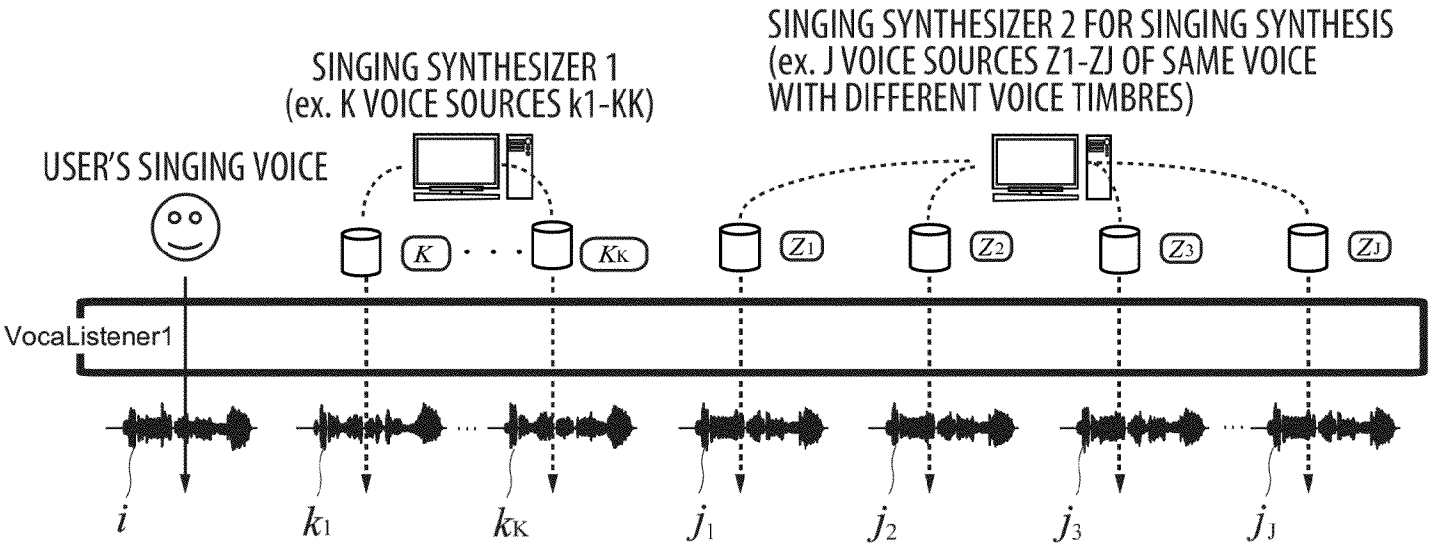
FIGS. 5A and 5B are used to explain the operation process in the embodiment of the present invention.

Singing synthesis parameter data suitable for singing voice source data are created by sequentially selecting from a singing voice source database 103. Then, the created parameter data are stored in the singing synthesis parameter data storing section 105. The singing voice source database 103 accumulates the singing voice source data on K sorts of different singing voices and singing voice source data on J sorts of singing voices of the same singer with J sorts of voice timbres. As shown in FIG. 5A, the singing voice source data on K sorts of different voices such as male voices, female voices, and children's voices can be obtained by using the existing singing synthesis system 1, for example. The singing voice source data on J sorts of singing voices of the same singer with J sorts of voice timbres can be obtained by using another existing singing synthesis system 2 capable of changing voice timbres like the "VOCALOID singing synthesis system" as shown in non-patent document 1. Note that K denotes an integer of one or more and J denotes an integer of two or more. The "VOCALOID" singing synthesis system as shown in non-patent document 1 is capable of creating singing voice source data on six sorts of voice timbres, DARK, LIGHT, SOFT, SOLID, SWEET, and VIVID as the J sorts of voice timbres.

The singing voice synthesizing section 101 receives an output from the singing synthesis parameter data storing section 105 operable to store singing synthesis parameter data representing the audio signal of the input singing voice and the audio signals of synthesized singing voices with a plurality of parameters including at least a pitch parameter and a dynamics parameter. Then, the singing voice synthesizing section 101 outputs an audio signal of the synthesized singing voice to the synthesized singing voice audio signal storing section 107, based on at least the singing voice source data on one sort of singing voice selected from the singing voice source database, the singing synthesis parameter data, and the lyrics data. The synthesized singing voice audio signal storing section 107 stores audio signals of K sorts of different time-synchronized synthesized singing voices as synthesized by the system 100 for singing synthesis reflecting pitch and dynamics changes and audio signals of J sorts of time-synchronized synthesized singing voices of the same singer with different timbres. The operations described so far are executed as step ST2 in FIG. 4. As shown in FIG. 5B, the K+J audio signals thus obtained reflect pitch and dynamics changes.

The system for estimation of singing synthesis parameter data roughly includes an input singing voice audio signal analyzing section 5, an analysis data storing section 7, a pitch parameter estimating section 9, a dynamics parameter estimating section 11, and a singing synthesis parameter data creating section 13. The input singing voice audio signal analyzing section 5 analyzes the pitch, dynamics, voiced frames, and vibrato frames of the input singing voice as features, and stores analysis results in the analysis data storing section 7. If an off-pitch estimating section 17, a pitch correcting section 19, a pitch transposing section, a vibrato adjusting section, and a smoothing section are not provided, it is not necessary to analyze vibrato frames as features. The input singing voice audio signal analyzing section 5 may arbitrarily be configured, provided that it is capable of analyzing or extracting the features of the input singing voice audio signal. The input singing voice audio signal analyzing section 5 of the present embodiment has the following four functions. The first function is to estimate the fundamental frequency $F_0$ of the input singing voice audio signal at a given interval, and stores the estimated fundamental frequency in the analysis data storing section 7 as feature data on the pitch of the input singing voice audio signal. The method of estimating the fundamental frequency is arbitrary. The fundamental frequency $F_0$ may be estimated from unaccompanied singing or accompanied singing. The second function is to estimate a periodicity score or voicedness from the input singing voice audio signal, and observe frames having higher periodicity scores than a predetermined threshold as voiced frames of the input singing voice audio signal and store analysis data in the analysis data storing section. The third function is to observe the features of dynamics of the input singing voice audio signal, and store the dynamics feature data in the analysis data storing section. The fourth function is to observe the frames, where vibrato is present, based on the pitch feature data and store analysis data as the vibrato frames in the analysis data storing section. Any of the publically known methods of detecting vibrato frames may be employed.

Assuming that the dynamics parameter is constant, the pitch parameter estimating section 9 estimates a pitch parameter capable of bringing the pitch features of the synthesized singing voice audio signal closer to the pitch features of the input singing voice audio signal, based on the pitch features of the input singing voice audio signal read from the analysis data storing section 7 and the lyrics data with syllabic boundaries indentified that are stored in the lyrics data storing section 15. Then, the singing synthesis parameter data creating section 13 creates tentative singing synthesis parameter data, based on the estimated pitch parameter. The singing voice synthesizing section 101 synthesizes a tentative singing voice based on the tentative singing synthesis parameter data. Thus, the pitch parameter estimating section 9 obtains an audio signal of the tentative synthesized singing voice. The tentative singing voice parameter data created by the singing synthesis parameter data creating section 13 are stored in the singing synthesis parameter data storing section 105. Through ordinary synthesizing operations, the singing voice synthesizing section 101 generates a tentative synthesized singing voice, based on the tentative singing synthesis parameter data and lyrics data, and outputs an audio signal of the tentative synthesized singing voice. The pitch parameter estimating section 9 repeats the estimation of pitch parameters until the pitch features of the tentative synthesized singing voice become closer to the pitch features of the input singing voice audio signal. The method of estimating pitch parameters is described in detail in patent document 1 and the description thereof is omitted herein. As with the input singing voice audio signal analyzing section 5, the pitch parameter estimating section 9 has a built-in function of analyzing the pitch features of the tentative synthesized singing voice audio signal output from the singing voice synthesizing section 101. The pitch parameter estimating section 9 repeats the estimation of pitch parameters a predetermined times, specifically four times. Alternatively, the pitch parameter estimating section 9 may be configured to repeat the estimation of pitch parameters until the pitch features of the tentative synthesized singing voice converge on the pitch features of the input singing voice audio signal. Even if different singing voice source data are used, or if a different method of singing synthesis is employed in the singing voice synthesizing section 101, the pitch features of the tentative synthesized singing voice audio signal automatically become closer to the pitch features of the input singing voice audio signal each time the estimation of pitch parameters is repeated. Iterative estimation of pitch parameters improves the quality and accuracy of singing synthesis by the singing voice synthesizing section 101.

After the pitch parameter estimation is completed, the dynamics parameter estimating section 11 calculates a relative numeric value of the dynamics features of the input singing voice audio signal with respect to the dynamics features of the synthesized singing voice audio signal, and estimates a dynamics parameter capable of bringing the features of the synthesized singing voice audio signal closer to the relative value of the dynamics features of the input singing voice audio signal. The singing synthesis parameter data creating section 13 creates a tentative singing synthesis parameter data, based on the pitch parameter estimated by the pitch parameter estimating section 9 and the dynamics parameter newly estimated by the dynamics parameter estimating section 11. Then, the singing synthesis parameter data creating section 13 stores the tentative singing synthesis parameter data in the singing synthesis parameter data storing section 105. The singing voice synthesizing section 101 synthesizes a tentative singing voice based on the tentative singing synthesis parameter data and outputs an audio signal of the tentative synthesized singing voice. The dynamics parameter estimating section 11 repeats the estimation of dynamics parameters a given times until the dynamics features of the tentative synthesized singing voice audio signal become closer to the relative value of the dynamics features of the input singing voice audio signal. As with the pitch parameter estimating section 9 and the input singing voice audio signal analyzing section 5, the dynamics parameter estimating section 11 has a built-in function of analyzing the dynamics features of the tentative synthesized singing voice audio signal output from the singing voice synthesizing section 101. The dynamics parameter estimating section 11 of the present embodiment repeats the estimation of dynamics parameters a predetermined times, specifically four times. Alternatively, the dynamics parameter estimating section 11 may be configured to repeat the estimation of dynamics parameters until the dynamics features of the tentative synthesized singing voice converge on the relative value of the dynamics features of the input singing voice audio signal. As with the estimation of pitch parameters, iterative estimation of dynamics parameters increases the accuracy of estimating the dynamics parameter.

The singing synthesis parameter data creating section 13 creates singing synthesis parameter data, based on the estimated pitch parameter data and estimated dynamics parameter, and stores the singing synthesis parameter data in the singing synthesis parameter data storing section 105.

The pitch parameter to be estimated by the pitch parameter estimating section 9 may be sufficient if it indicates pitch changes. In the present embodiment, the pitch parameter is constituted from the following parameter elements: a parameter element which indicates a reference pitch level for a plurality of sub-frames of the input singing voice audio signal corresponding to a plurality of syllables of the lyrics data; a parameter element which indicates relative temporal changes in pitch with respect to the reference pitch level for the sub-frame signals; and a parameter element which indicates a change width of the sub-frame signal toward higher pitch.

Returning to FIG. 2, if the lyrics data with syllabic boundaries identified are used, such data are directly stored in the lyrics data storing section 15. If the lyrics data without syllabic boundaries identified are stored in the singing synthesis parameter data storing section 13, the lyrics alignment section 3 creates lyrics data with syllabic boundaries identified, based on the lyrics data without syllabic boundaries identified and the input singing voice audio signal.

The musical quality of audio signals of input singing voices cannot always be assured. In some cases, off-pitch and improper vibrato phrases are found in the input singing voices. In most cases, the key of singing differs between male and female singers. To be prepared for these situations, the system of the present embodiment includes an off-pitch estimating section 17, a pitch correcting section 19, a pitch transposing section 21, a vibrato adjusting section 23, and a smoothing section 25 as shown in FIG. 2. In the present embodiment, the audio signals of the input singing voices can be edited using these sections, thereby expanding the representation of the input singing voices. Specifically, the following two editing functions can be implemented. These functions can be utilized according to the situations, and, of course, there is an option of using none of the functions.

(A) Pitch Transposition

Off-pitch correction: To correct off-pitch sounds.

Pitch transposition: To synthesize singing in a range where is impossible for the singer to maintain true pitch.

(B) Modification of Singing Styles

Adjustment of vibrato extent: To adjust vibrato extent as the user likes with an intuitive operation such as strengthening and weakening the vibrato.

Smoothing of pitch and dynamics: To suppress pitch overshoot and fine fluctuation.

To implement the above-mentioned editing functions, the off-pitch estimating section 17 estimates an off-pitch amount based on the pitch feature data stored in an analysis data storing section 7, the pitch feature data indicating the pitches invoiced frames in which audio signals of input singing voices are continuous. The pitch correcting section 19 corrects the pitch feature data so as to exclude from the pitch feature data the off-pitch amount estimated by the off-pitch estimating section 17. Thus, audio signals of singing voices with low off-pitch extent can be obtained by estimating the off-pitch amount and excluding the estimated off-pitch from the pitch feature data. The pitch transposing section 21 is used to transpose the pitch by adding/subtracting an arbitrary value to/from the pitch feature data. With the pitch transposing section 21, it is possible to simply change or transpose the voice range of the audio signals of input singing voices. The vibrato adjusting section 23 arbitrarily adjusts the vibrato extent in vibrato frames. The smoothing section 25 arbitrarily smooth the pitch feature data and dynamics feature data in frames other than the vibrato frames. Here, the smoothing performed in non-vibrato frames is equivalent to the "arbitrary adjustment of vibrato extent" performed in vibrato frames. Thus, the smoothing produces effect of increasing or decreasing the fluctuations in pitch and dynamics in the non-vibrato frames. These functions are described in detail in patent document 1, and the explanations thereof are omitted herein.

In the present embodiment, a system for singing synthesis capable of reflecting voice timbre changes using a singing synthesis system 100 reflecting pitch and dynamics changes as shown in FIG. 2 includes the above-mentioned synthesized singing voice audio signal storing section 107, a spectral envelope estimating section 109, a voice timbre space estimating section 111, a trajectory shifting and scaling section 113, a first spectral transform curve estimating section 115, a second spectral transform curve estimating section 117, a spectral transform surface generating section 119, and a synthesized audio signal generating section 121 as shown in FIG. 3. These structural elements perform steps ST3 to ST7 of FIG. 4.

The spectral envelope estimating section 109 applies frequency analysis to the audio signal i of the input singing voice and audio signals $k_1$-$k_K$ of K sorts of different synthesized singing voices where K is an integer of one or more and audio signals $j_1$-$j_J$ of J sorts of synthesized singing voices of the same singer with different voice timbres where J is an integer of two or more, as shown in FIG. 5A. Then, in step ST3 of FIG. 4, the spectral envelope estimating section 109 estimates S spectral envelopes with influence of pitch ($F_0$) removed, based on results of the frequency analysis of these audio signals. Hereinafter in the signal processing, signals based on the audio signal i of the input singing voice, the audio signals $k_1$-$k_K$ of K sorts of synthesized singing voices, and the audio signals $j_1$-$j_J$ of J sorts of synthesized singing voices are designated with reference numerals i, $k_1$-$k_K$, and $j_1$-$j_J$ for the sake of simplicity. A difference in voice timbre can be defined as a difference in shape of a spectral envelope as obtained from the frequency analysis of the audio signals. The difference in shape of a spectral envelope, however, includes differences in phonemes and a singer's individuality. More exactly, temporal changes with the effect of phonemes and individuality being suppressed can be considered as voice timbre changes. In the present embodiment, spectral envelopes are focused on as acoustic features well representing the voice timber changes. The technique called STRAIGHT, a speech analysis and synthesis system described in the document shown below, is employed to obtain spectral envelopes with influence of pitch ($F_0$) removed in respect of the audio signal of the input singing voice and the audio signals of K+J sorts of synthesized singing voices to which the frequency analysis has been applied.

For the technique called STRAIGHT, refer to the document: Kawahara H., Masuda-Katsuse, I., and de Cheveigne, A., "Restructuring speech representations using a pitch adaptive time-frequency smoothing and an instantaneous frequency based on F0 extraction: Possible role of a repetitive structure in sounds", Speech Communication, Vol. 27, pp. 187-207 (1999). The processing based on this spectral envelope, as called STRAIGHT envelope, has been known to provide high quality re-synthesizing with transformed spectral envelopes. Refer to non-patent document 2.

Figure 6:
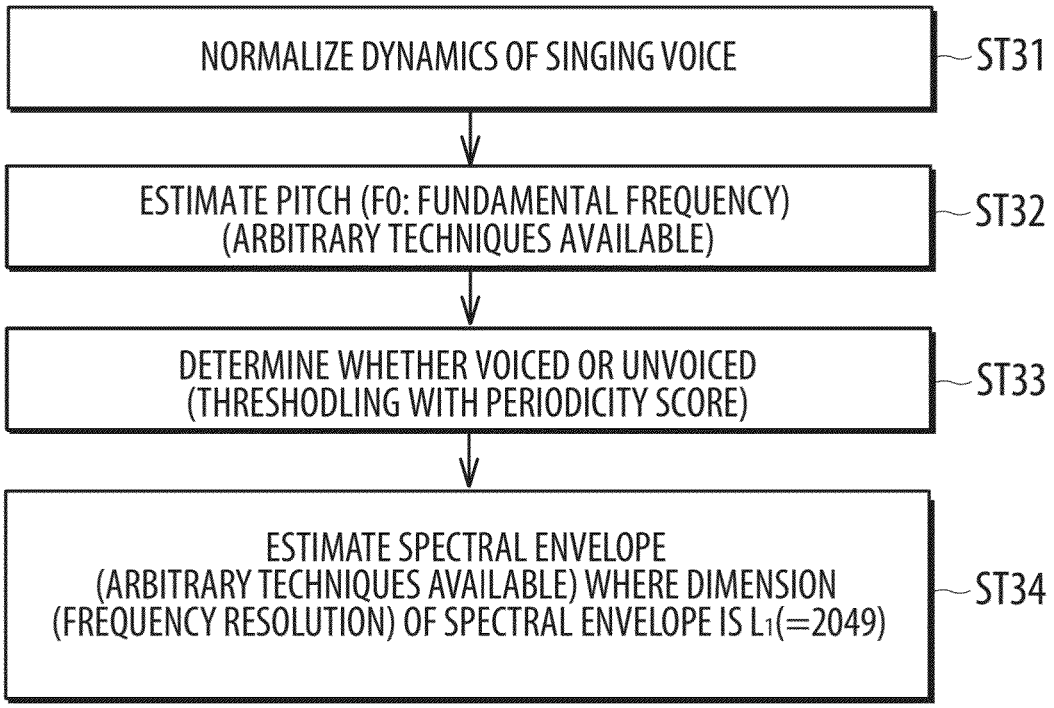
FIG. 6 is a flowchart showing an algorithm to estimate a spectral envelope.

Specifically, the spectral envelope estimating section 109 performs respective steps of the flowchart of FIG. 6 showing an algorithm for estimating a spectral envelope using a computer. As shown in FIG. 5B, the "VocaListener" described in patent document 1 and non-patent documents 16 and 17 is used to synthesize K+J audio signals $k_1$-$k_K$ and $j_1$-$j_J$. Here, it can be considered that there are only fluctuations corresponding to the differences in individuality (voice quality) and voice timbre in the spectral envelopes of a singer for all of the audio signals at a certain instant of time. This is because the "VocaListener" synthesizes the singing voices by mimicking the singers' voices such that the pitch, dynamics, and phonemes of the synthesized voices may be the same as those of the singers' voices. Although there are absolute differences in pitch between male and female singers, it is assumed that the differences in pitch have been removed by envelope estimation of the STRAIGHT technique. In actuality, if the pitch significantly differs, the shape of the spectral envelope may accordingly differ. However, it is considered that pitch differences in terms of several halftones can be absorbed by the STRAIGHT technique. Thus, differences in envelope shape due to the pitch differences larger than several halftones are treated as differences in voice timbre. If the principal component analysis results for each frame indicate large variance among singing voices having different voice timbers for each frame in a low dimensional subspace, such subspace can be considered as making large contribution to voice timbre changes, and that the individuality of the singer remains in this subspace.

First, in step ST31, the spectral envelope estimating section 109 normalizes dynamics of S audio signals comprised of the audio signal i of input singing voice, the audio signals $k_1$-$k_K$ of the K sorts of synthesized singing voices, and the audio signals $j_1$-$j_J$ of J sorts of synthesized singing voices where $S=i+k_1-k_K+j_1-j_J$.

Figures 7C, 7D, 7E:
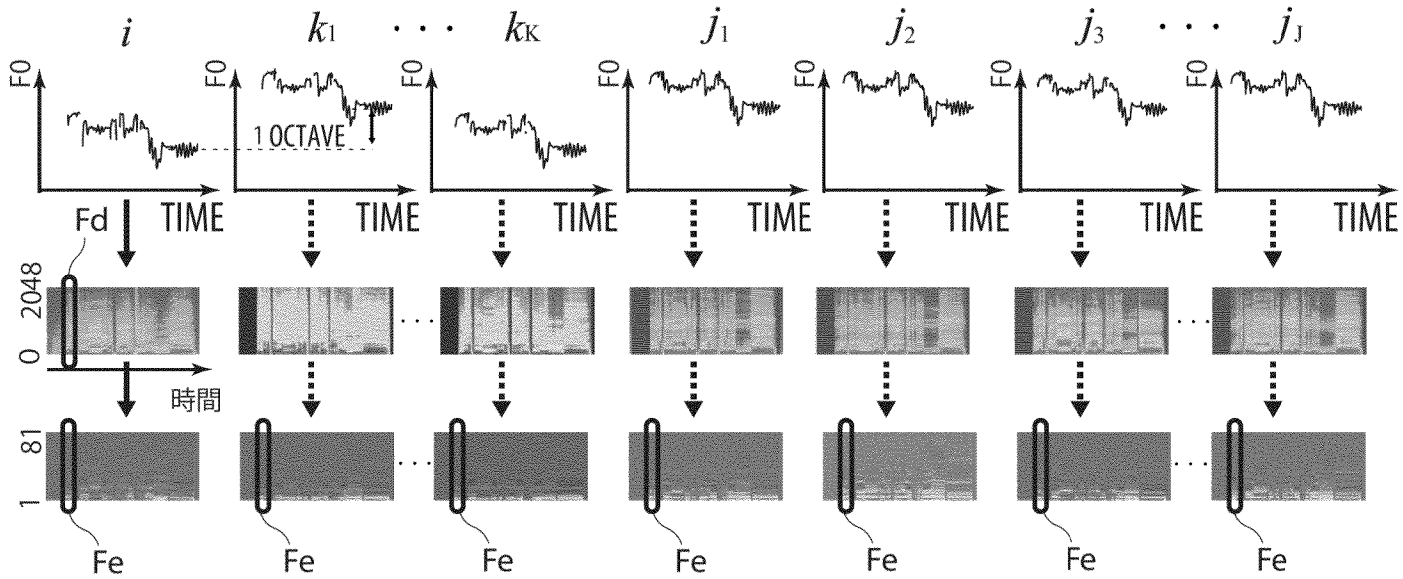
FIGS. 7C to 7E are used to explain the operation process in the embodiment of the present invention.
Figure 8A:
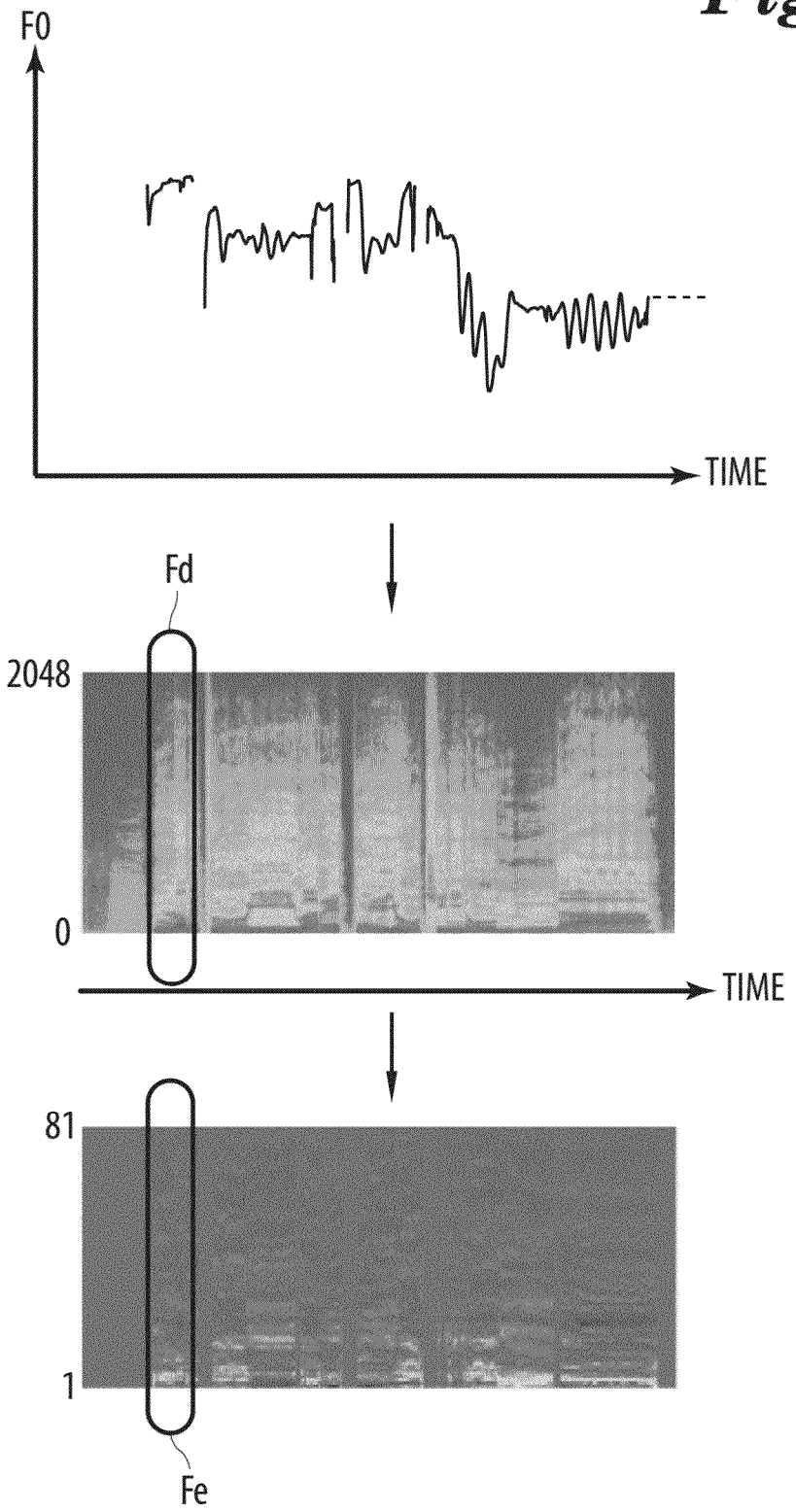
FIG. 8A is an enlarged illustration of a waveform of audio signal i shown in FIGS. 7C to 7E.
Figure 8B:
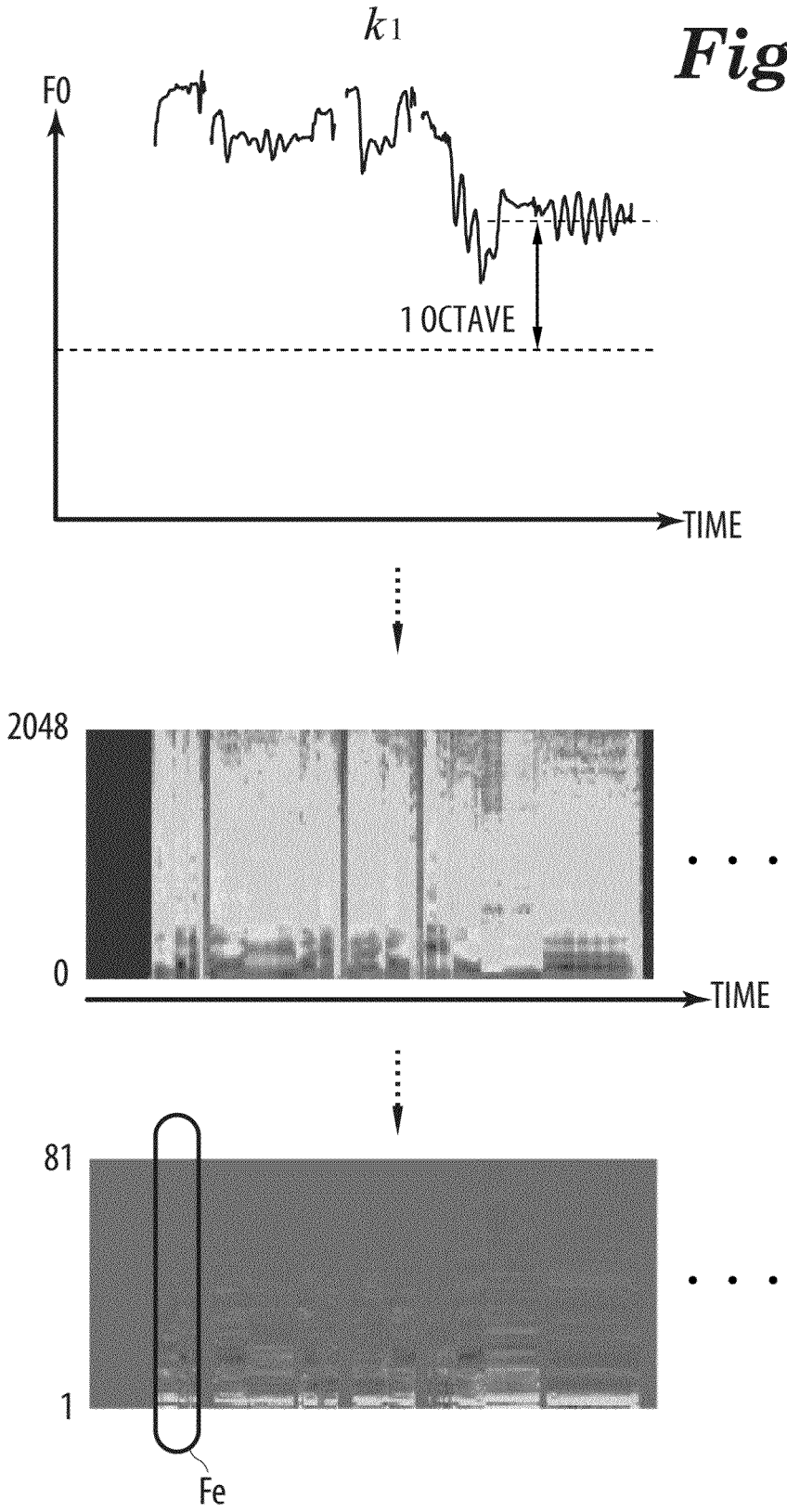
FIG. 8B is an enlarged illustration of a waveform of audio signal $k_1$ shown in FIGS. 7C to 7E.
Figure 8C:
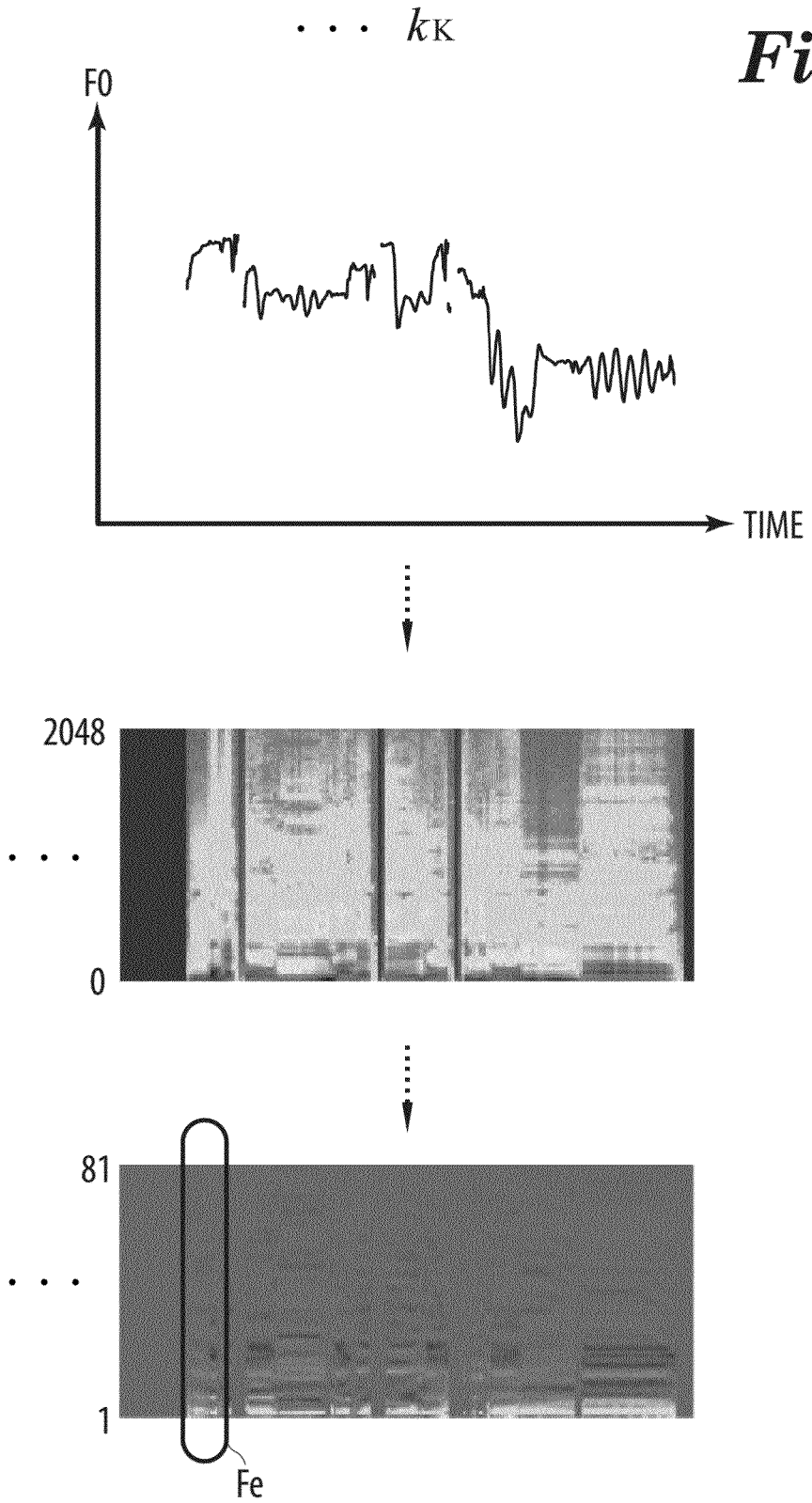
FIG. 8C is an enlarged illustration of a waveform of audio signal $k_k$ shown in FIGS. 7C to 7E.
Figure 8D:
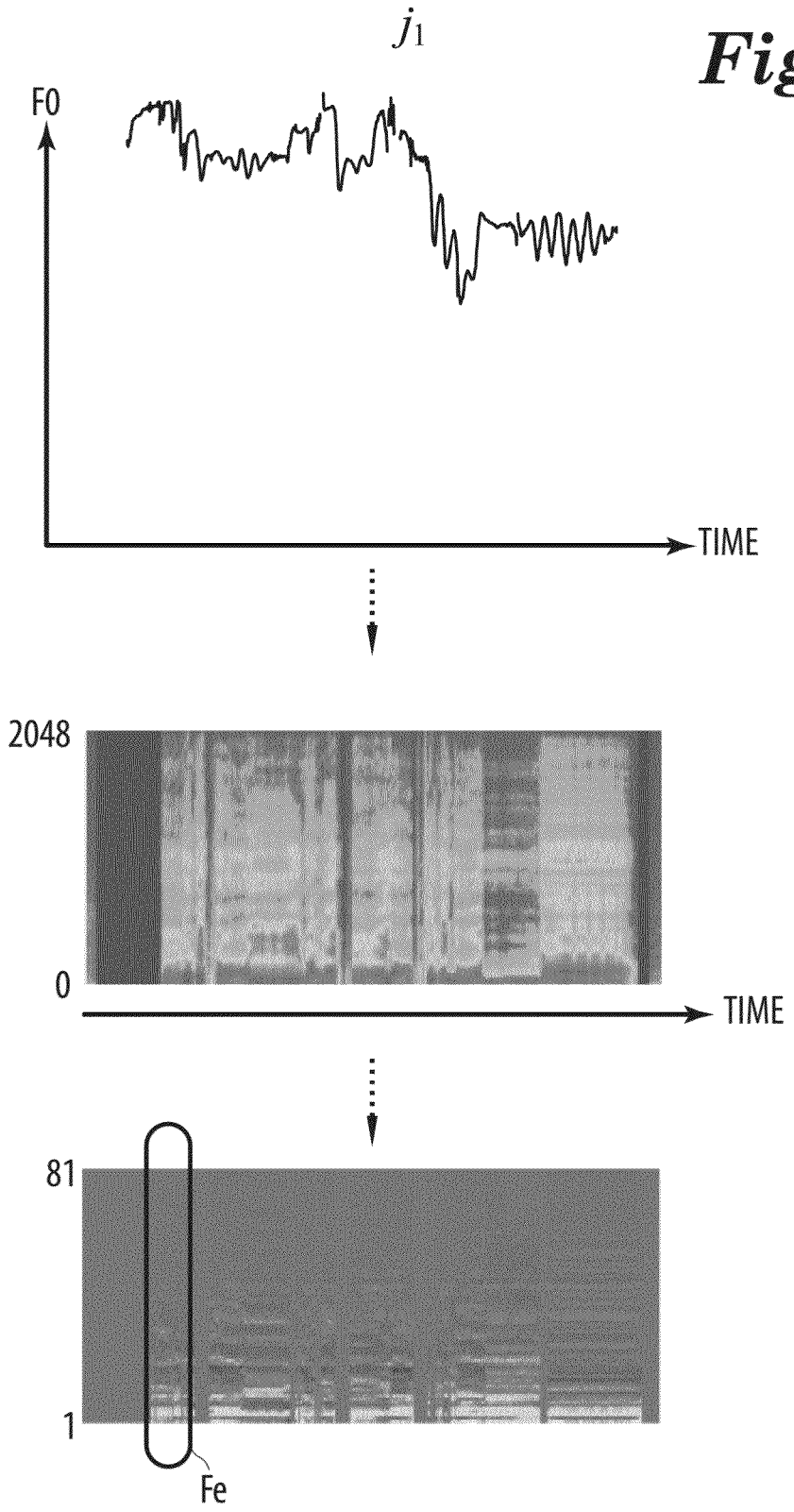
FIG. 8D is an enlarged illustration of a waveform of audio signal $j_1$ shown in FIGS. 7C to 7E.
Figure 8E:
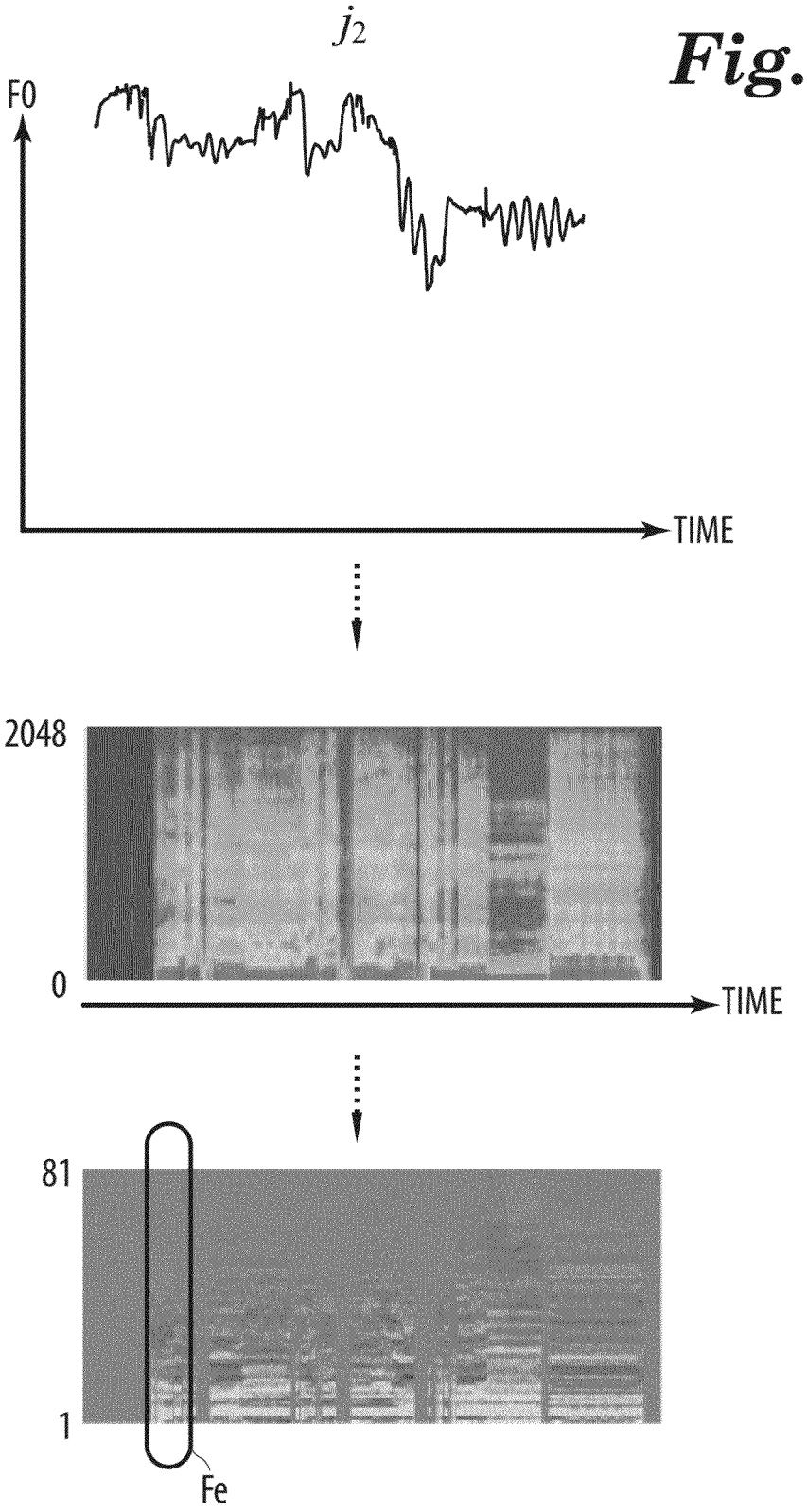
FIG. 8E is an enlarged illustration of a waveform of audio signal $j_2$ shown in FIGS. 7C to 7E.
Figure 8F:
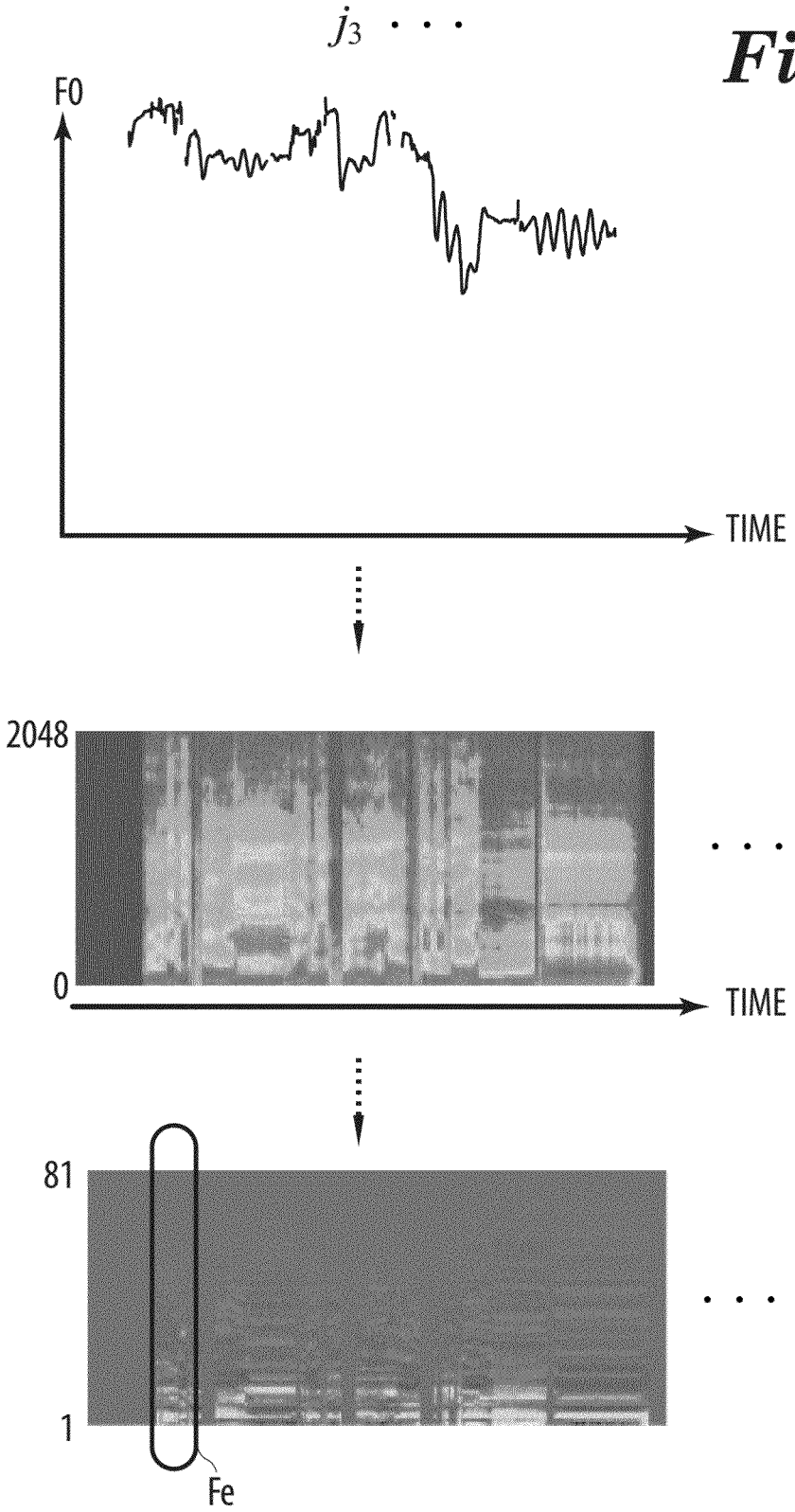
FIG. 8F is an enlarged illustration of a waveform of audio signal $j_3$ shown in FIGS. 7C to 7E.
Figure 8G:
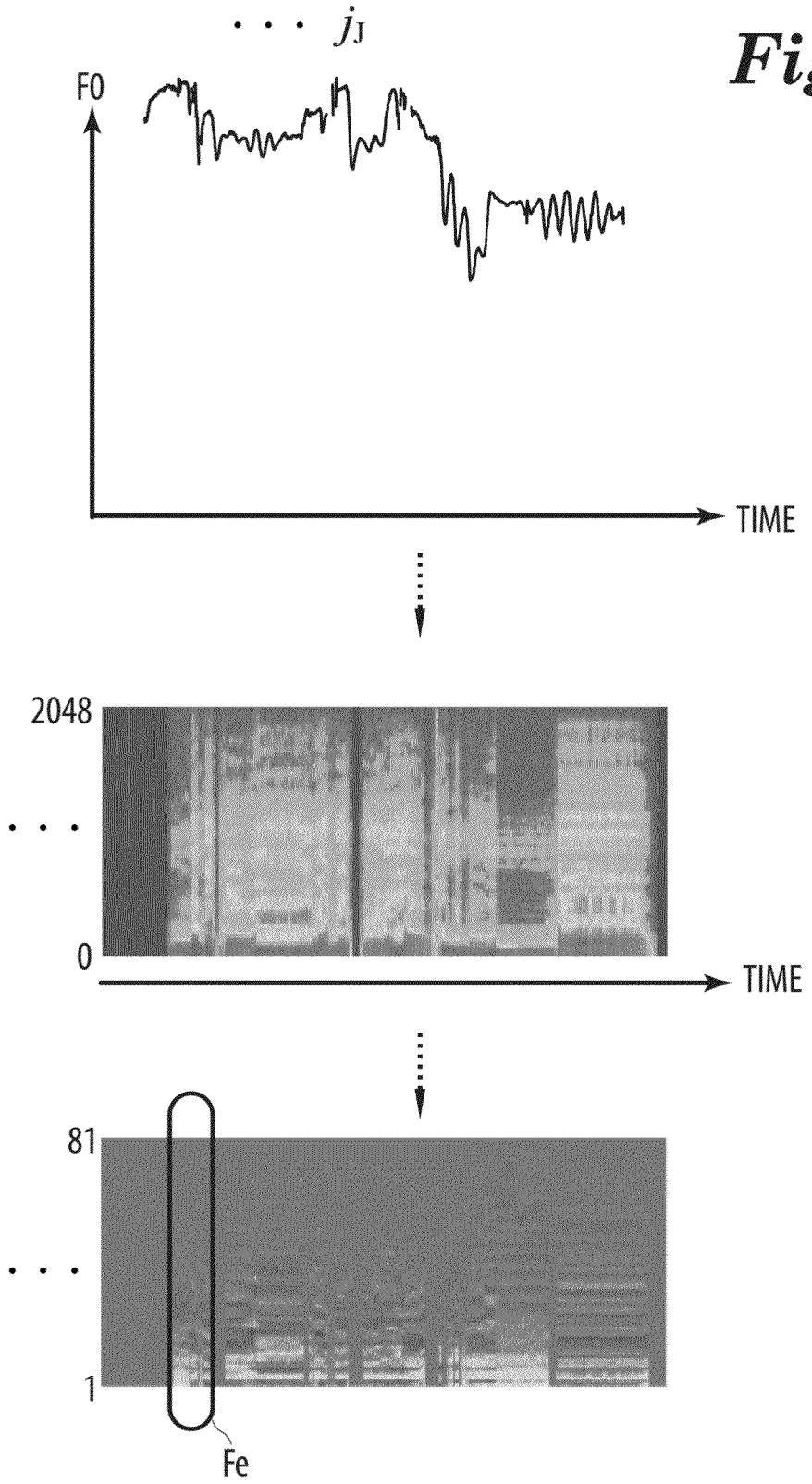
FIG. 8G is an enlarged illustration of a waveform of audio signal $j_j$ shown in FIGS. 7C to 7E.

Then, in step ST32, the spectral envelope estimating section 109 applies frequency analysis to the S normalized audio signals, and estimates a plurality of pitches and non-periodic components for a plurality of frequency bands based on results of the frequency analysis. The method of estimating pitches and non-periodic components is arbitrary. For example, the following method of pitch estimation can be employed: Kawahara H., Masuda-Katsuse, I., and de Cheveigne, A., "Restructuring speech representations using a pitch adaptive time-frequency smoothing and an instantaneous frequency based on F0 extraction: Possible role of a repetitive structure in sounds", Speech Communication, Vol. 27, pp. 187-207 (1999). The following method of non-periodic component estimation can be employed: Kawahara, H., Jo Estill and Fujimura, O., "A periodicity extraction and control using mixed mode excitation and group delay manipulation for a high quality speech analysis, modification and synthesis system STRAIGHT", MAVEBA 2001, Sep. 13-15, Firenze, Italy, 2001. In step ST33, the spectral envelope estimating section 109 determines whether a frame is voiced unvoiced by comparing the estimated pitch with a threshold of periodicity score. Refer to FIG. 7C. This step of determination is needed because it is necessary to perform the analysis and synthesis separately for the voiced and unvoiced frames in the process of spectral estimation. For the voiced frames, a plurality of frequency spectral envelopes are estimated in an $L_1$ dimension based on fundamental frequencies $F_0$ (which is a basis for the analysis) of the respective audio signals. Here, $L_1$ is an integer of the power of 2 plus 1. For the unvoiced frames, a plurality of frequency spectral envelopes are estimated in the $L_1$ dimension based on a predetermined low frequency (which is a basis for the analysis). Smooth spectral envelopes with the effect of $F_0$ removed can be obtained by determining the frequencies as a basis for the analysis. The frequency as a basis for the analysis is $F_0$ for the voiced frames, and a low frequency lower than $F_0$ sufficient for spectral envelope estimation for the unvoiced frames. For example, in the technique described in the "Restructuring speech representations using a pitch adaptive time-frequency smoothing and an instantaneous frequency based on F0 extraction: Possible role of a repetitive structure in sounds", Kawahara H., Masuda-Katsuse, I., and de Cheveigne, A., Speech Communication, Vol. 27, pp. 187-207 (1999), analyzing windows having time lengths corresponding to the respective frequencies of audio signals are used to estimate spectral envelopes.

In step ST34 of FIG. 6, the spectral envelope estimating section 109 estimates the S spectral envelopes based on the plurality of frequency spectral envelopes for the voiced frames and the plurality of frequency spectral envelopes for the unvoiced frames, and the non-periodic components. Refer to FIG. 7D. The estimation of spectral envelopes and the estimation of non-periodic components are not limited to those employed in the present embodiment. An arbitrary method with high accuracy can be employed to increase synthesis accuracy. In the present embodiment, $L_1$ dimension (frequency resolution) of 2049 is employed and steps ST32 to ST34 of FIG. 6 are performed per processing time unit (1 ms), namely, for each frame.

In the present embodiment, a voice timbre space estimating section 111 and a trajectory shifting and scaling section 113 are employed to suppress the components of differences in phonemes and individuality. The voice timbre space estimating section 111 estimates an M-dimensional voice timbre space reflecting the voice timbres of the input singing voice and J sorts of voice timbres by suppressing the components other than the components contributing to the voice timbre changes from the time sequence of S spectral envelopes by means of the processing based on the subspace method. Here, M is an integer of one or more and S=K+J+1. In the subspace method, the time sequence of S (S=K+J+1) spectral envelopes is used as a collection of learning data, and a subspace (eigenvector) is created, representing the features of the learning data in low dimensions. The components contributing to voice timbre changes are identified by evaluating the similarity between the created subspace and the time sequence of S (K+J+1) spectral envelopes. The voice timbre space is a virtual space in which components other than the voice timbre changes are suppressed. In the voice timbre space, S audio signals correspond to one point in the voice timbre space at each instant of time. Temporal changes at one point in the voice timbre space can be represented as a trajectory changing in the voice timbre space as the time elapses.

In the above-mentioned subspace method, it has been confirmed by known studies that the subspace-based methods are effective in speaker recognition and voice quality conversion based on the separation of phonetic space and the speaker space. Two examples of such studies are shown below.

Study 1: Nishida Masafumi and Ariki Yasuo, "Speaker Recognition by Projecting to Speaker Space with Less Phonetic information", Trans. of IEICE, Vol. J85-D2, No. 4, pp. 554-562 (2002).

Study 2: Inoue Toru, Nishida Masafumi, Fujimoto Masakiyo, and Ariki Yasuo, "Voice conversion using subspace method and Gaussian mixture model", IEICE Technical Report SP, Vol. 101, No. 86, pp. 1-6 (2001).

In the above-identified two studies, the phonetic space (a low dimensional subspace: a component with large fluctuations) and the speaker space (a high dimensional subspace: a component with small fluctuations) are separated by constructing a subspace for each speaker. In the present embodiment, a subspace is constructed for each frame. With this, however, different subspaces are constructed for the respective frames, and all frames cannot be treated in a unified manner. Then, only low N-dimensional principal components are stored in the subspace for each frame and a spectral envelope is restored, thereby suppressing components other than components contributing to voice quality and voice timber changes. Following that, all of the frames of all of synthesized singing voices are serially concatenated and principal component analysis is applied to the frames all together. Thus, a resulting low M-dimensional space is regarded as a voice timbre space. Through this processing, it is possible not only to deal with all of the frames of different singing voices in the same space but also to efficiently represent in low dimensions those components relating to voice timbre changes accompanying the phonetic changes in lyrics context. To obtain a highly expressive space, it is desirable to use many singers in constructing a voice timbre space. A larger value is preferable for K audio signals. Further, suppression of excessive components is considered to be important in alignment with the input singing.

Figure 9:
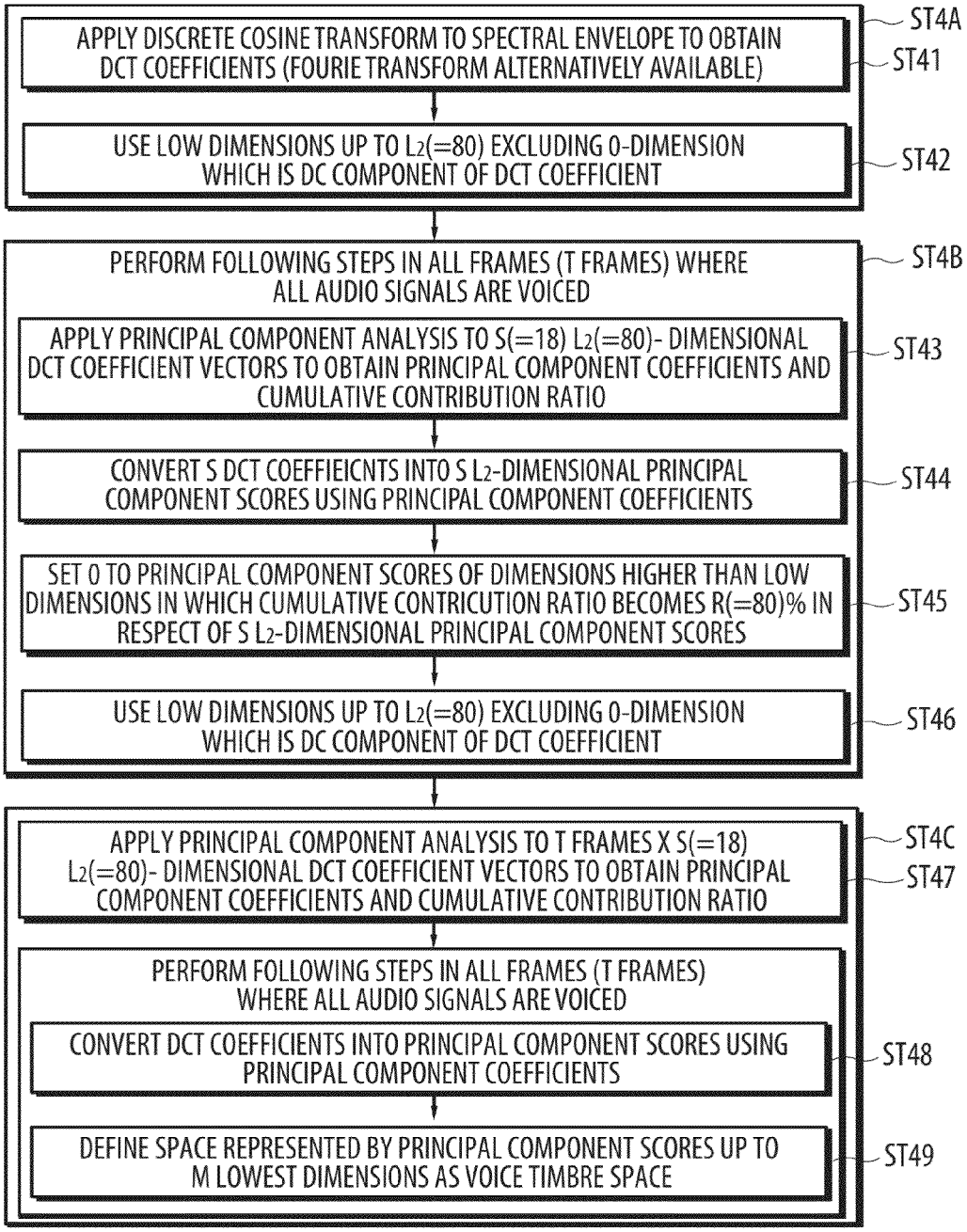
FIG. 9 is a flowchart showing an algorithm to implement the voice timbre space estimating section of the present invention using a computer.
Figure 13A:
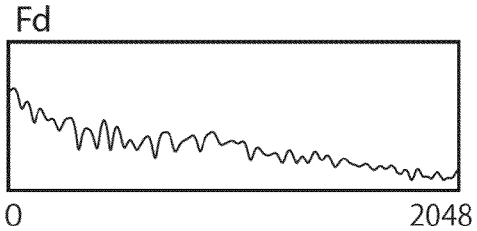
FIGS. 13A to 13E are enlarged views showing waveforms in the frames shown in FIGS. 7, 10, and 12.
Figure 13B:
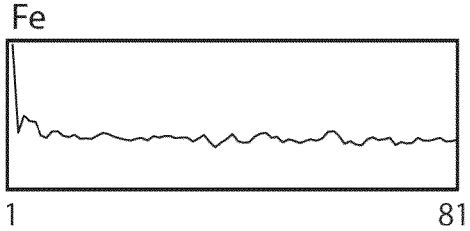

Specifically, the voice timbre estimating section 111 of the present embodiment performs steps in the flowchart of FIG. 9 showing an algorithm to implement the voice timbre estimating section 111 using a computer. The voice timbre estimating section 111 applies discrete cosine transform to the S spectral envelopes for each frame Fd as shown in FIG. 7D, and S discrete cosine transform coefficients shown as DCT coefficients in FIG. 9 are obtained for each frame Fd as shown in FIG. 7E. FIGS. 8A to 8G are enlarge illustrations of the waveforms of S audio signals i, $k_1$-$k_K$, and $j_1$-$j_J$ of FIGS. 7C to 7E. FIGS. 13A and 13B are enlarged diagrammatic views showing example waveforms in the frames Fd and Fe of FIGS. 7D and 7E for ready understanding. Frames Fd and Fe are located at the same instant of time and different reference signs are allocated to the frames for discrimination.

In FIG. 7E (FIG. 13B), $L_2$-dimensional, specifically low 80-dimensional discrete cosine transform coefficient vectors, which are indicated as DCT coefficient vectors in FIG. 9, are shown for one frame Fe where $L_2<L_1$ and $L_2$ is a positive integer, and $L_2$ dimension excludes 0-dimension which is a DC component for one frame Fe. In step ST42, discrete cosine transform coefficient vectors up to the low $L_2$-dimension are obtained as targets for analysis where $L_2<L_1$ and $L_2$ is a positive integer. In step ST4A, steps ST41 and 42 are performed for each frame of all of the audio signals.

Figures 10E, 10F, 10G:
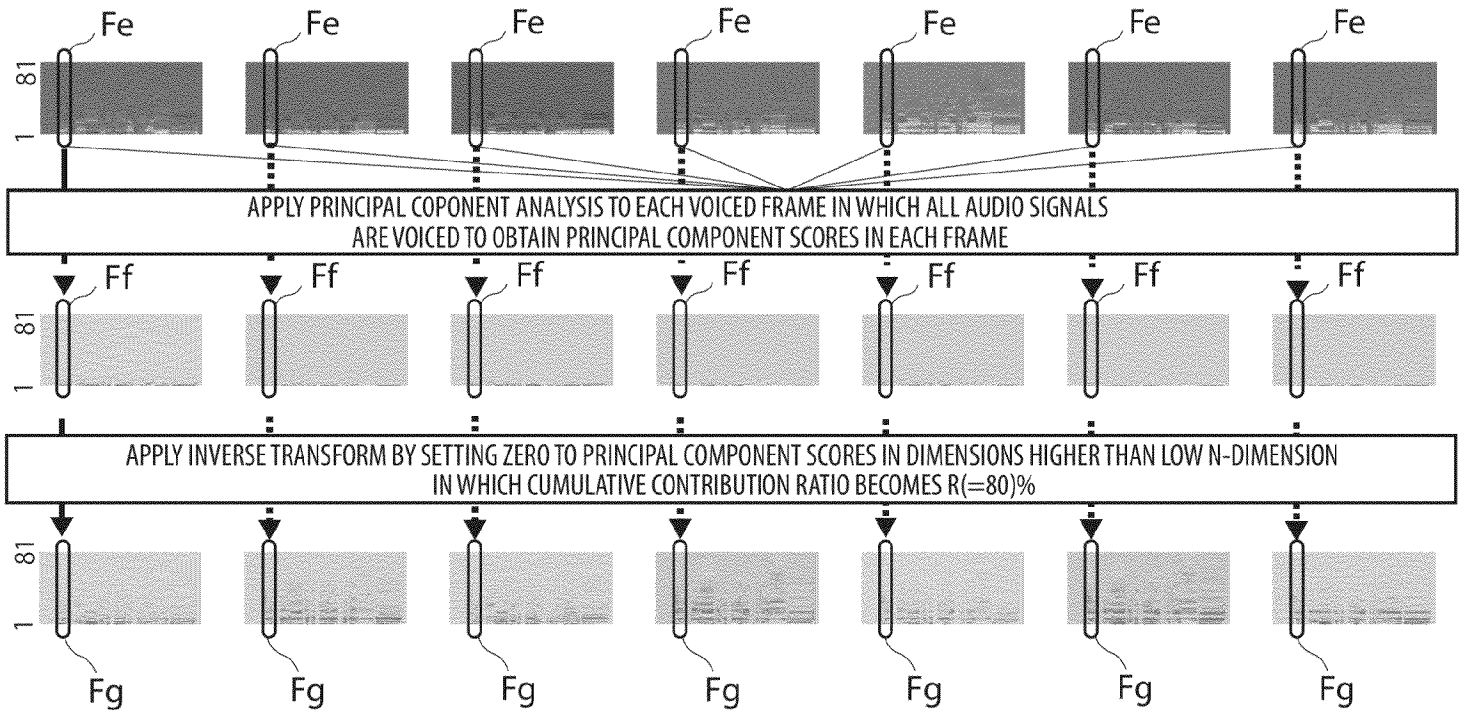
FIGS. 10E to 10G are used to explain the operation process in the embodiment of the present invention.
Figure 11A:
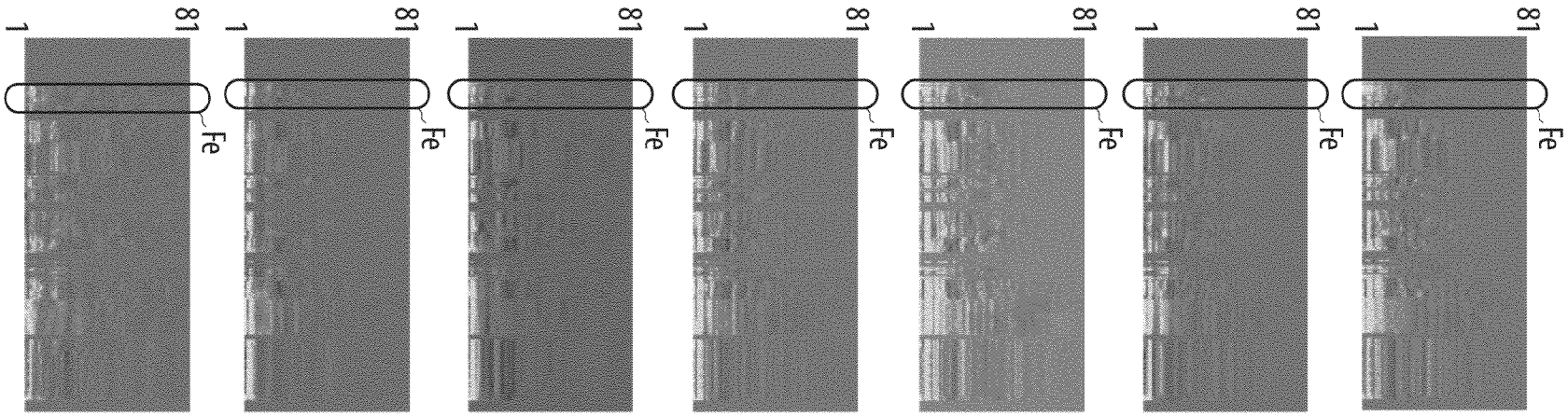
FIG. 11A is an enlarged illustration showing the waveforms of FIG. 10E in a vertical arrangement.
Figure 11B:
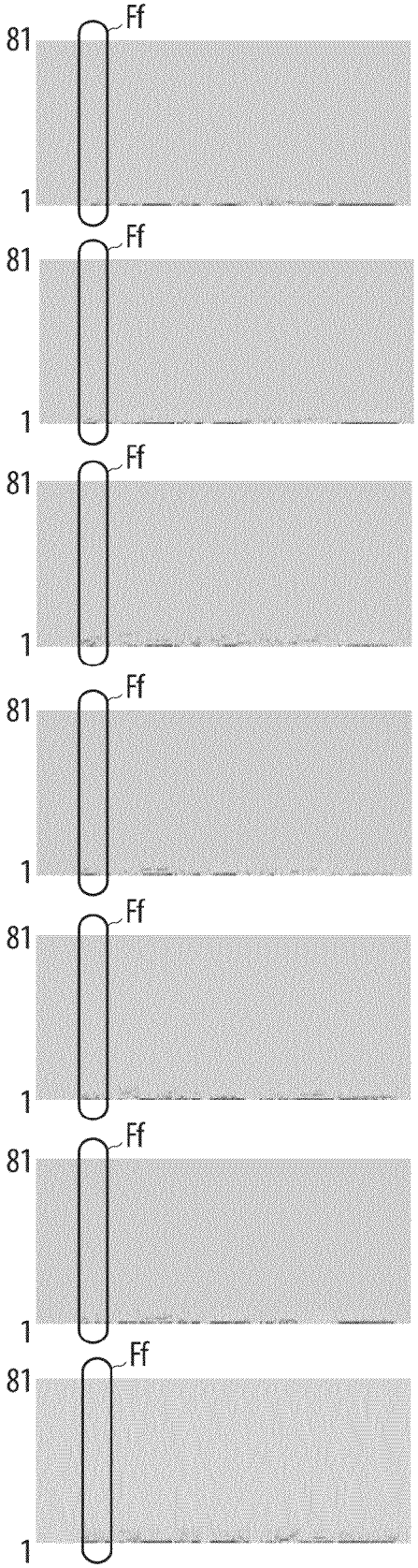
FIG. 11B is an enlarged illustration showing the waveforms of FIG. 10F in a vertical arrangement.
Figure 11C:
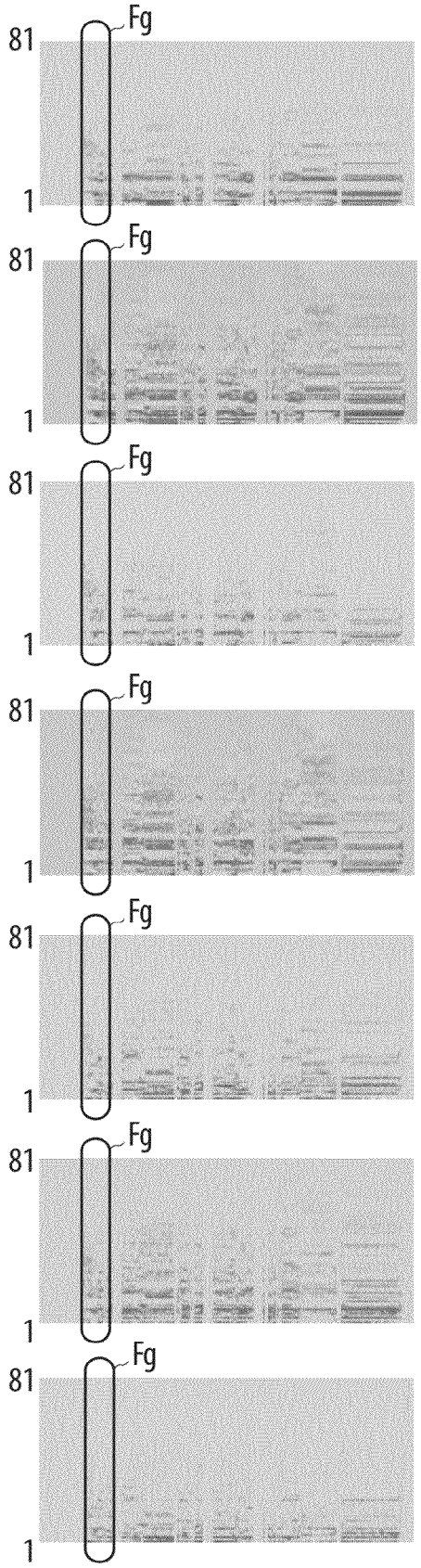
FIG. 11C is an enlarged illustration showing the waveforms of FIG. 10G in a vertical arrangement.
Figure 11D:
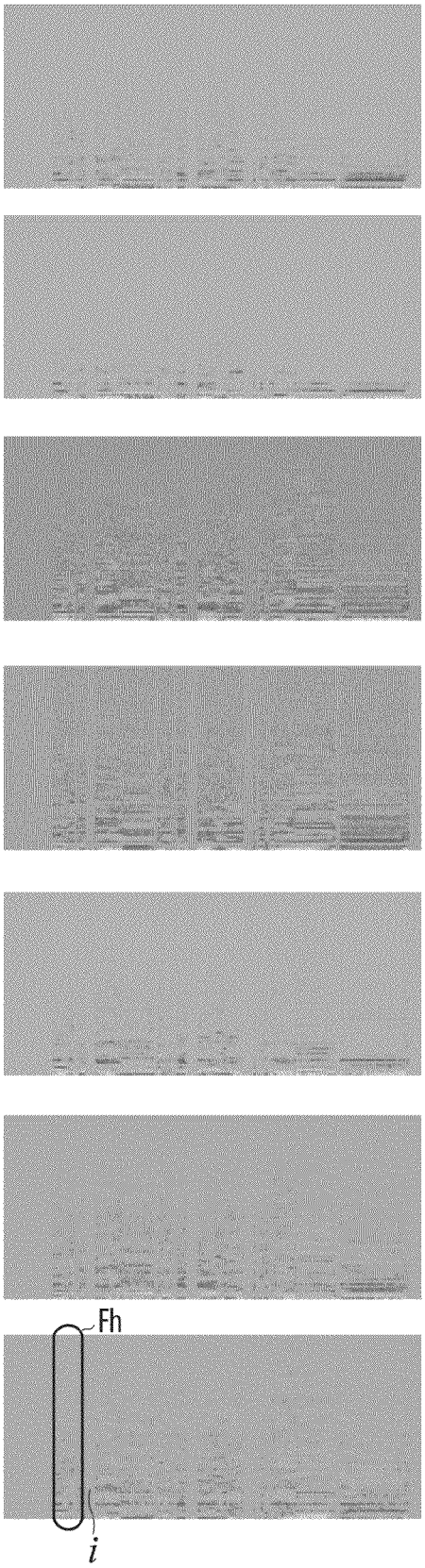
FIG. 11D is an enlarged illustration showing the waveforms of FIG. 12H in a vertical arrangement.

In step ST43, the voice timbre estimating section 111 applies principal component analysis to the S $L_2$-dimensional discrete cosine transform coefficient vectors in each of T frames in which the S audio signals i, $k_1$-$k_K$, and $j_1$-$j_J$ are voiced at the same instant of time where T is the number of seconds of duration of the audio signal×(multiplied by) sampling period at a maximum. Thus, principal component coefficients and a cumulative contribution ratio are obtained for each of the S $L_2$-dimensional discrete cosine transform coefficient vectors. Next in step ST44, the S discrete cosine transform coefficients are converted into S $L_2$-dimensional principal component scores for each of the T frames by using the principal component coefficients. Refer to FIG. 10F. Then, in step ST45, the voice timbre estimating section 111 sets zero to principal component scores in dimensions higher than the low N-dimension in which a cumulative contribution ratio becomes R %. Here, $0<R<100$, specifically R=80 in the present embodiment and N is an integer of $1\leq N\leq L_2$ as determined by R. Next, referring to step ST46 and FIGS. 10G and 12G, the voice timbre estimating section 111 applies inverse transform to the S N-dimensional principal component scores of which high dimensional principal component scores have been set to zero, to thereby convert the scores into S new $L_2$-dimensional discrete cosine transform coefficients by using the corresponding principal component coefficients. Steps ST43 to ST46 (step ST4B) are performed in all of the above-mentioned T frames. FIG. 11A is an enlarged illustration showing S waveforms of FIG. 10E. FIG. 11B is an enlarged illustration showing S waveforms of FIG. 10F. FIG. 11C is an enlarged illustration showing S waveforms of FIG. 10G. FIG. 11D is an enlarged illustration showing S waveforms of FIG. 12H. FIGS. 13C and 13D are enlarged diagrammatic views showing example waveforms in the frames Ff and Fg of FIGS. 10F and 10G for ready understanding. Frames Fd, Fe, Ff and Fg are located at the same instant of time and different reference signs are allocated to the frames for discrimination.

Further, in step ST47, the voice timbre estimating section 111 applies principal component analysis to T×S new $L_2$-dimensional discrete cosine transform coefficient vectors to obtain principal component coefficients and a cumulative contribution ratio for each of the T×S new $L_2$-dimensional discrete cosine transform coefficient vectors. Referring to step ST48 and FIG. 12H, the $L_2$-dimensional discrete cosine transform coefficients are converted into principal component scores by using the obtained principal component coefficients. FIG. 13E is an enlarged view showing an example waveform in frame Fh of FIG. 12H for ready understanding. Frames Fd, Fe, Ff, Fg, and Fh are located at the same instant of time and different reference signs are allocated to the frames for discrimination.

Figures 12G, 12H, 12I, 12J:
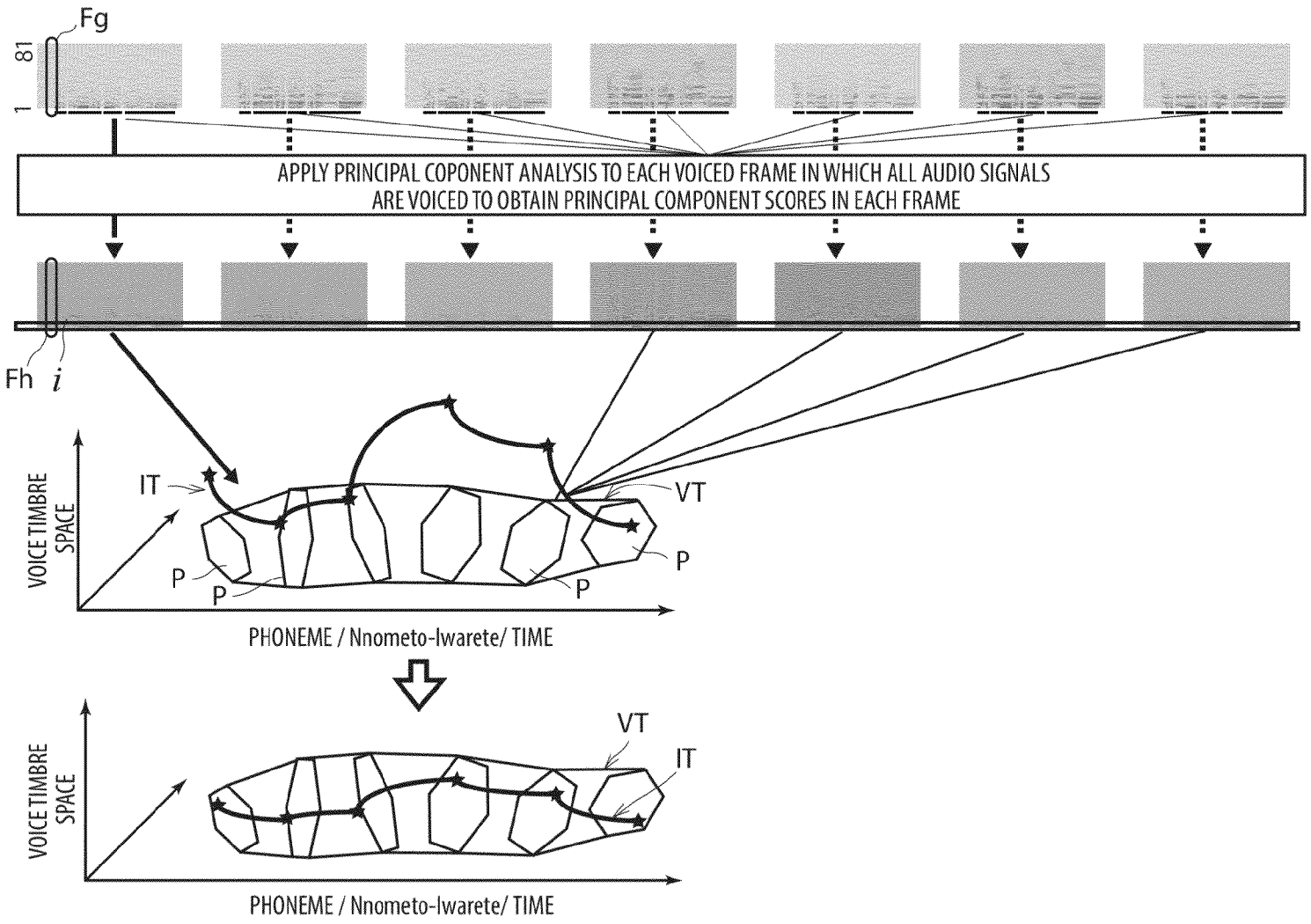
FIGS. 12G to 12J are used to explain the operation process in the embodiment of the present invention.
Figure 13C:
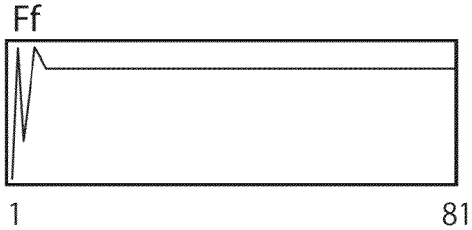
Figure 13D:
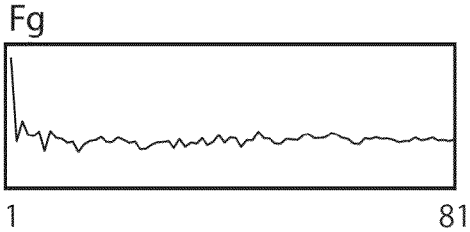
Figure 13E:
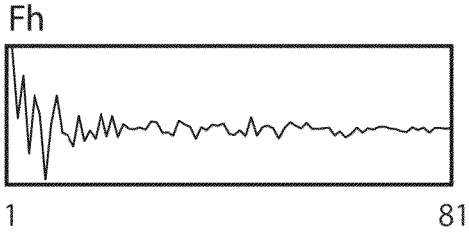

Then, referring to step ST49 and FIG. 12I, a space represented by the principal component scores up to M lowest dimensions is defined as the voice timbre space where $1\leq M\leq L_2$. If discrete cosine transform is used to define the voice timbre space, it is possible to reproduce spectral envelopes by reducing the number of dimensions, from $L_1$ to $L_2$. Fourier transform may be used in place of the discrete cosine transform.

Referring to FIG. 12I, the trajectory shifting and scaling section 113 estimates a positional relationship of the J sorts of voice timbres at each instant of time with M-dimensional vectors in the voice timbre space which is an M-dimensional space, from the J spectral envelopes for the audio signals of the J sorts of different singing voices synthesized from the same singer's voice with different voice timbres. Prior to this, the J sorts of voice timbres at each instant of time have been obtained by suppressing the components other than the components contributing to the voice timbre changes by means of the processing based on the subspace method. The trajectory shifting and scaling section 113 also estimates a time trajectory of the positional relationship of the voice timbres estimated with the M-dimensional vectors as a timbre change tube in the voice timbre space. In other words, assuming that the voice timbre space is an M-dimensional space, J M-dimensional vectors zj=1, 2, . . . , J(t) are present at each instant of time t in the voice timbre space for the target voice, and the inside area encompassed by the J points J(t) is a transposable area for the target singing voice of the same singer. Here, a polytope P is defined as being encompassed by J positions which are obtained in the voice timbre space for voice timbres of J different time-synchronized synthesized singing voices of the same singer with different voice timbres, as shown in FIG. 12I. A time trajectory of the polytope P is assumed to be a timbre change tube VT. FIG. 12I schematically illustrates the timbre change tube VT and the polytope P, which are actually cubic.

Referring to FIG. 12I, the trajectory shifting and scaling section 113 estimates a positional relationship of the voice timbres of the input singing voice at each instant of time with M-dimensional vectors from the spectral envelope for the audio signal i of the input singing voice. Prior to this, the voice timbres of the input singing voice at each instant of time have been obtained by suppressing the components other than the components contributing to the voice timbre changes by means of the processing based on the subspace method. The trajectory shifting and scaling section 113 also estimates a time trajectory of the positional relationship of the voice timbres of the input singing voice estimated with the M-dimensional vectors as a voice timbre trajectory IT of the input singing voice. Further, referring to FIG. 12J, the trajectory shifting and scaling section 113 shifts or scales at least one of the voice timbre trajectory IT of the input singing voice and the timbre change tube VT such that the entirety or a major part of the voice timbre trajectory IT of the input singing voice is present inside the timbre change tube VT. Assuming that the voice timbre space is an M-dimensional space, it can be considered that a target voice to be synthesized is present as J M-dimensional vectors in the M-dimensional space at each instant of time t. Then, it is assumed that the inside of the tube encompassed by J positions is a transposable area of the input singing voice of the same singer. Namely, the polytope P (M-dimensional polytope) changing from moment to moment is a transposable area of voice timbres. The target position for synthesis at each instant of time is determined by shifting or scaling the voice timbre trajectory IT of the input singing voice existing in a different position in the same voice timbre space such that the trajectory is present inside the timbre change tube. In other words, it is done by scaling at least one of the voice timbre trajectories IT and the timbre change tube VT without changing the time axis, and shifting the position thereof. Then, based on the determined target position for synthesis, a transform spectral envelope is generated for a synthesized singing voice reflecting voice timbres of the input singing voice.

Figure 14:
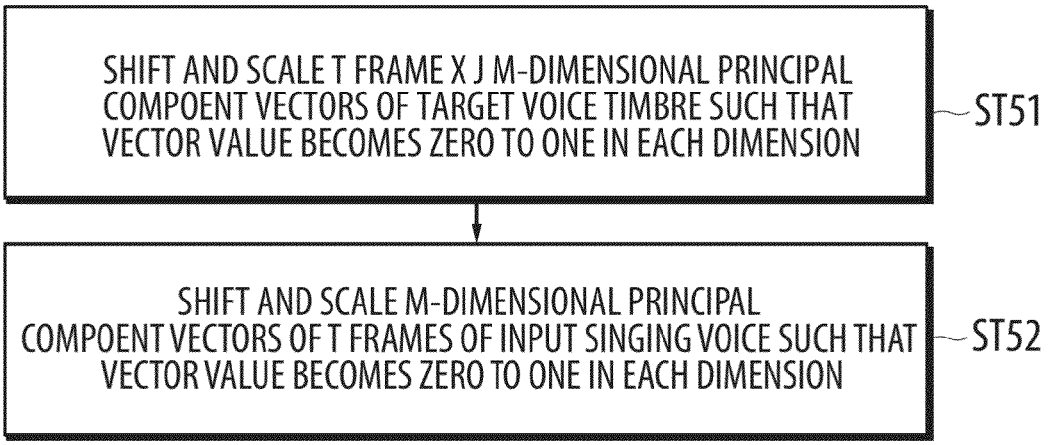
FIG. 14 is a flowchart showing an example algorithm to implement the trajectory shifting and scaling section of the present invention using a computer.

FIG. 14 shows the details of step ST5 of FIG. 4, and is a flowchart showing an example algorithm to implement the trajectory shifting and scaling section 113 using a computer. According to the algorithm, in step ST51, J×T M-dimensional principal component score vectors, which form the timbre change tube VT, for the J synthesized singing voice audio signals are shifted and scaled such that the vector value falls within the range of 0 to 1 in each dimension. Then in step ST52, T M-dimensional principal component score vectors, which form the voice timbre trajectory IT of the input singing voice, for the input singing voice audio signal are shifted and scaled such that the vector value falls within the range of 0 to 1 in each dimension. Thus, the entirety or a major part of the voice timbre trajectory IT of the input singing voice is placed inside the timbre change tube VT. Shifting and scaling in this manner enables the entirety or a major part of the voice timbre trajectory IT of the input singing voice to be placed inside the timbre change tube VT. Step ST52 may be performed before step St51.

Figure 15:
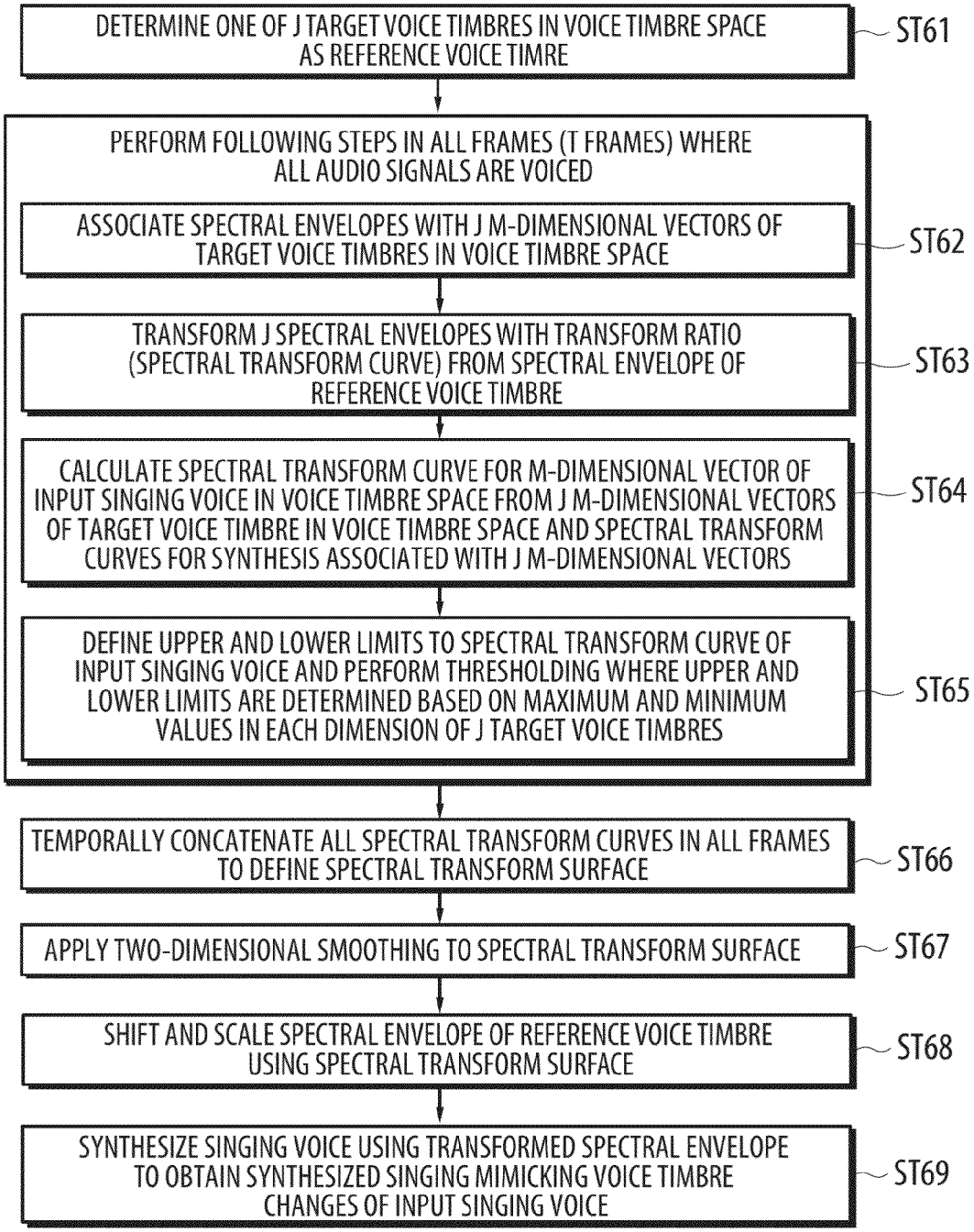
FIG. 15 is a flowchart showing an algorithm to implement the first spectral transform curve estimating section, the second spectral transform curve estimating section, the spectral transform surface generating section, and the synthesized audio signal generating section of the present invention using a computer.
Figure 16:
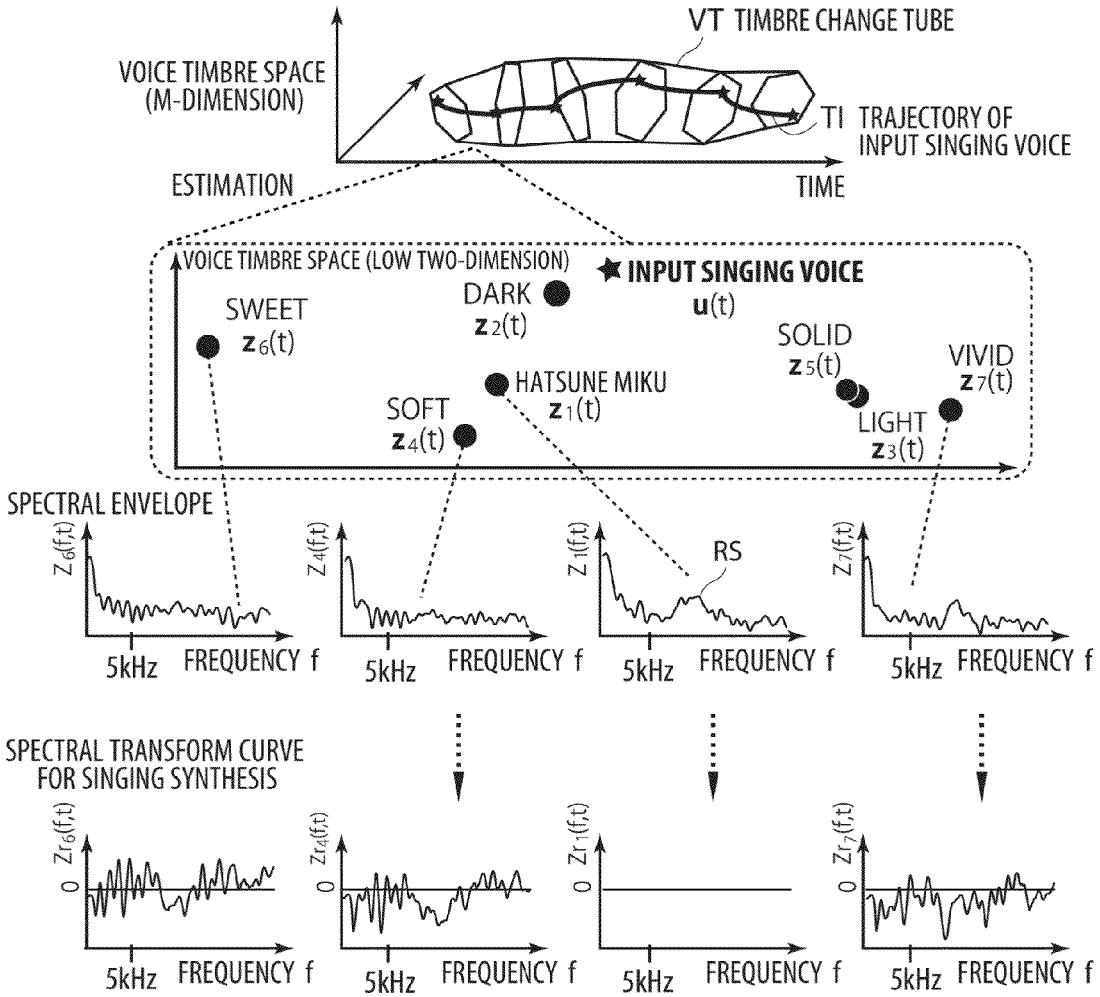
FIG. 16 is used to explain a process of generating a spectral transform curve.

FIG. 15 shows the details of step ST6 of FIG. 4, and is a flowchart showing an algorithm to implement the first spectral transform curve estimating section 115, the second spectral transform curve estimating section 117, the spectral transform surface generating section 119, and the synthesized audio signal generating section 121 of FIG. 3 using a computer. FIG. 16 is used to explain a process of generating a spectral transform curve. In the present embodiment, the spectral envelopes are not used as they are. First, the first spectral transform curve estimating section 115 estimates J spectral transform curves for singing synthesis. The first spectral transform curve estimating section 115 defines one of J sorts of target voices for synthesis in the voice timbre space as a reference voice. Specifically, the first spectral transform curve estimating section 115 defines one of the J sorts of singing voice source data as reference singing voice source data in step ST61. Then, steps ST62 to ST65 are performed in all of the frames in which all of the audio signals are voiced. Namely, these steps are performed in each of T frames in which S audio signals are voiced at the same instant of time. Here, T denotes the duration of the audio signal in seconds×sampling period at a maximum.

In step ST62, in each frame, spectral envelopes are associated with J M-dimensional vectors corresponding to J singing voice source data including target singing voices in the voice timbre space. The spectral envelope for the audio signal of a synthesized singing voice corresponding to the reference singing voice source data is defined as a reference spectral envelope RS. In FIG. 16, six sorts of singing voice source data are constructed to contain six sorts of singing voices synthesized from the same singer's voice with six sorts of voice timbres, DARK, LIGHT, SOFT, SOLID, SWEET, and VIVID, using a singing synthesis system of an applied product of Crypton Future Media, Inc., "Hatsune Miku Append (MIKU Append)" (a trademark). Singing voice source data are constructed to contain singing voices of "Hatsune Miku" synthesized using a singing synthesis system of an applied product of Crypton Future Media, Inc., "Hatsune Miku" (a trademark). Then, J sorts of singing voice source data are constructed based on both of the above-mentioned singing voice source data. The spectral envelopes for the audio signals corresponding to the singing voice source data of "Hatsune Miku" is defined as a reference spectral envelope RS. FIG. 16 illustrates spectral envelopes for voice timbres, SOFT, SWEET, and VIVID. In step ST63, the first spectral transform curve estimating section 115 estimates J spectral transform curves for singing synthesis in correspondence with the J sorts of voice timbres by calculating at each instant of time transform ratios of the J spectral envelopes for the audio signals of the J sorts of synthesized singing voices over the reference spectral envelope RS, and defining the transform ratios as the J spectral transform curves for singing synthesis. The spectral transform curve for singing synthesis indicates changes in transform ratio calculated at each instant of time. As shown in the lowermost part of FIG. 16, the spectral transform curve for singing synthesis of the reference spectral envelope RS corresponding to the singing voice source data of "Hatsune Miku" is a straight line.

In step ST64, spectral transform curves for the M-dimensional vectors of the input singing voice in the voice timbre space are calculated from the spectral transform curves for singing synthesis corresponding to the M-dimensional vectors for J sorts of voice timbres to be synthesized in the voice timbre space. To implement step ST64, the second spectral transform curve estimating section 117 estimates a spectral transform curve IS, shown in FIG. 17, corresponding to the voice timbre trajectory IT of the input singing voice at each instant of time so as to satisfy the following constraint: when one point of the voice timbre trajectory IT of the input singing voice determined by the trajectory shifting and scaling section 113 overlaps a certain voice timbre inside the timbre change tube VT at a certain instant of time, a spectral envelope for an audio signal of the input singing voice at the certain instant of time should coincide with the spectral envelope of the synthesized singing voice with the overlapped voice timbre. This spectral transform curve IS is intended to mimic the voice timbres of the input singing voice in the voice timbre space.

Figure 17:
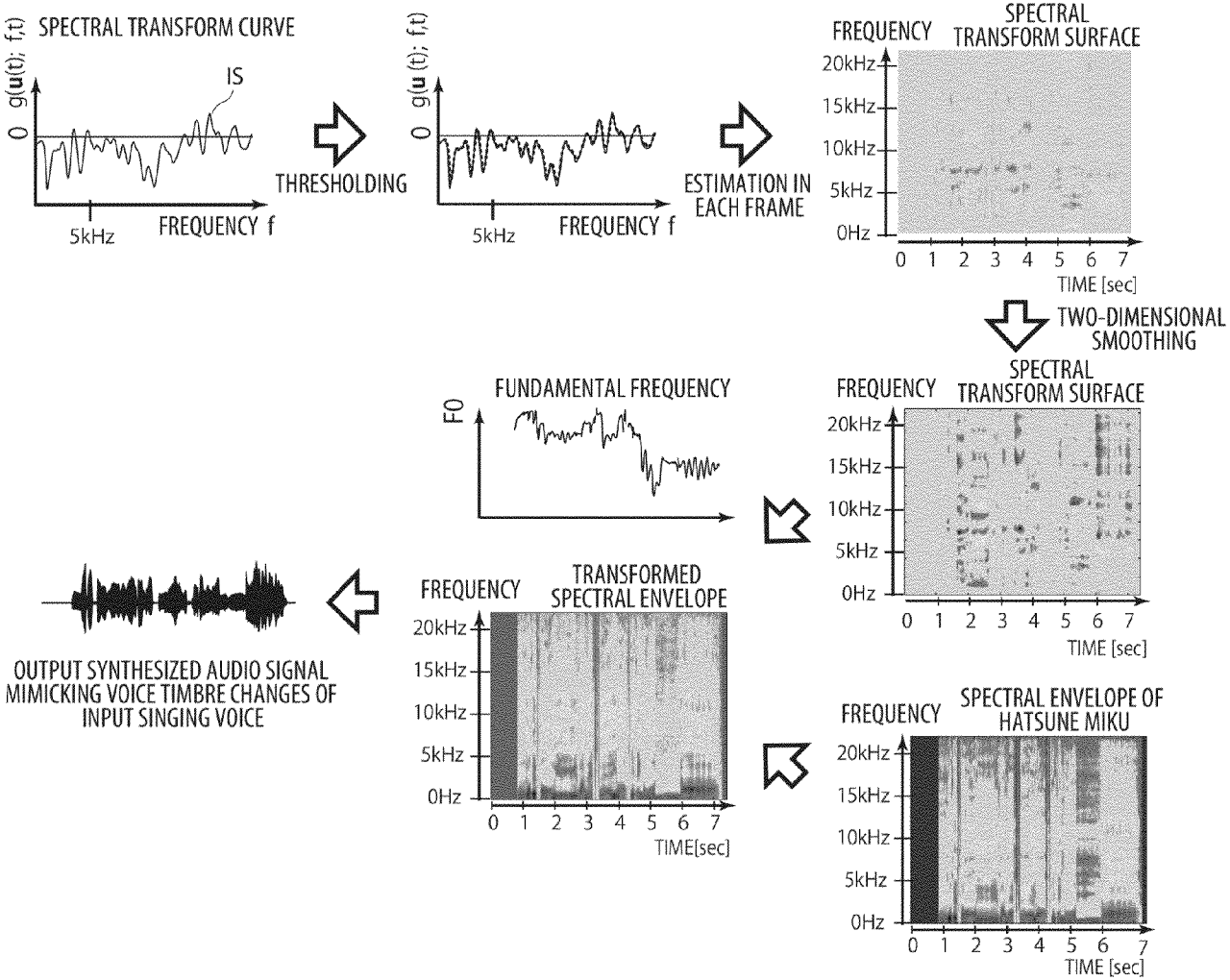
FIG. 17 is used to explain a process of generating a spectral transform surface and a synthesized audio signal.

According to the above-mentioned constraint, in FIG. 16, when one point of the voice timbre trajectory IT of the input singing voice as indicated with an asterisk * overlaps a certain voice timbre, for example, "DARK" inside the timbre change tube VT at a certain instant of time, the spectral envelope of the input singing voice audio signal at the certain instant of time coincides with the spectral envelope of a synthesized singing voice having the overlapped voice timbre, DARK. Namely, according to the constraint, the spectral transform curve IS, shown in FIG. 17, is estimated at each instant of time such that the spectral envelope of the input singing voice audio signal at the certain instant of time coincides with the spectral envelope of a synthesized singing voice with the overlapped voice timbre, DARK. In other words, as shown in FIG. 16, when one point of the voice timbre trajectory IT of the input singing voice as indicated with an asterisk * does not overlap a certain voice timbre, for example, "DARK" inside the timbre change tube VT at a certain instant of time, the spectral transform curve IS, shown in FIG. 17, is estimated at each instant of time based on a positional relationship between the one point of the voice timbre trajectory IT of the input singing voice as indicated with an asterisk * and J sorts of voice timbres inside the timbre change tube VT.

Next in step ST65, thresholding is performed by defining upper and lower limits for the spectral transform curve IS of the input singing voice at each instant of time as shown in FIG. 17. In the thresholding process, the spectral transform curves IS are cut when they exceed the upper and/or lower limits. The upper and lower limits are determined based on the maximum and minimum values of the spectral transform curve for singing synthesis for J sorts of target voice timbres.

FIG. 17 illustrates a process of generating a synthesized audio signal using the spectral transform curves IS. The spectral transform surface generating section 119 estimates a spectral transform surface by temporally concatenating all the spectral transform curves IS at every instant of time (in all frames) in step ST66. Two-dimensional smoothing is applied to the spectral transform surface in step ST67. The spectral envelope for the audio signal of the reference voice timbre, which is the spectral envelope of Hatsune Miku in FIG. 17, is transformed lasing the smoothed spectral transform surface in step ST68. Then in step ST69, singing is synthesized using the transformed spectral envelope and the fundamental frequency ($F_0$) of the reference audio signal, and an audio signal of a synthesized singing voice mimicking voice timbre changes of the input singing voice is generated. The synthesized audio signal may be reproduced by a signal reproducing section 123. Alternatively, the synthesized audio signal may be stored in an appropriate recording medium.

Now, the following paragraphs will describe a specific example in which the estimation described so far is implemented through mathematic operations. In the present embodiment, spectral envelopes are not used as they are. A reference voice, for example, the voice of "Hatsune Miku" without voice timbre changes, not "Hatsune Miku Append" with voice timbre changes, is used as a reference, and a transform ratio is calculated with respect to the reference voice. The transform ratio is estimated for each frame. This ratio is the above-mentioned spectral transform curve. If the input singing voice overlaps each point of voice timbre in the voice timbre space, the spectral transform curve at that instant of time is estimated so as to satisfy a constraint that the spectral transform curve of the input singing voice should be the spectral transform curve of a synthesized voice with the overlapped voice timbre. For the estimation in such manner, the Variational Interpolation using Radial Basis Function is adapted and applied. The technique is described in the following document: Turk, G. and O'Brien, J. F. "Modeling with implicit surfaces that interpolate", ACM Transaction on Graphics, Vol. 21, No. 4, pp. 855-873 (2002).

Here, it is assumed that the spectral envelope of each voice timbre at an instant of time t and an frequency f is Zj=1, 2, . . . , J(f,t), the spectral transform surface for Z1(f,t) is Zrj(f,t), an input singing voice in the voice timbre space is u(t), and each voice timbre is zj(t). A spectral transform curve for mimicking the voice timbre of the input singing voice is obtained by solving the following equation with constraints.

⟨Equation 1⟩

$$Zr_j(f,t) = \log\left(\frac{Z_j(f,t)}{Z_1(f,t)}\right) \tag{1}$$

$$g(u(t);f,t) = \sum_{k=1}^{J}(w_k(f,t)\cdot\phi(u(t)-z_k(t))) + P(u(t);f,t) \tag{2}$$

$$Zr_j(f,t) = \sum_{k=1}^{J}(w_k(f,t)\cdot\phi(z_j(t)-z_k(t))) + P(z_j(t);f,t) \tag{3}$$

$$g(z_j(t);f,t) = Zr_j(f,t) \tag{4}$$

$$P(x;f,t) = p_0(f,t) + \sum_{m=1}^{M} p_m(f,t)\cdot x^{(m)} \tag{5}$$

$$Zr_j(f,t) = \log\left(\frac{Z_j(f,t)}{Z_1(f,t)}\right)$$

$$g(u(t);f,t) = \sum_{k=1}^{J}(w_k(f,t)\cdot\phi(u(t)-z_k(t))) + P(u(t);f,t)$$

$$Zr_j(f,t) = \sum_{k=1}^{J}(w_k(f,t)\cdot\phi(z_j(t)-z_k(t))) + P(z_j(t);f,t)$$

$$g(z_j(t);f,t) = Zr_j(f,t)$$

$$P(x;f,t) = p_0(f,t) + \sum_{m=1}^{M} p_m(f,t)\cdot x^{(m)}$$

In the above equation, $Z_{rj}(f,t)$ takes logarithm as shown in expression (1), and allows linear conversion of the ratio on the logarithmic axis and a negative value of estimation result; $w_k(f,t)$ are the weights and P(•) is an M-variable first-degree or linear polynomial (pm=0, . . . , M) in which $z_j(t)$ is a vector x and u(t) is a variable as shown in expression (5); φ(•) is a function representing a inter-vector distance, and is defined herein as φ(•)=|•|. Instead, φ(•)=$|•|^2$ Log(•) or φ(•)=$|•|^3$ may be used. Expression (4) corresponds to the above-mentioned constraint, and can be represented as a matrix shown below where the voice timbre space is an M (=3) dimensional space.

⟨Equation 2⟩

$$\begin{bmatrix} \phi_{11} & \phi_{12} & \dots & \phi_{1J} & 1 & z_1^{(1)} & z_1^{(2)} & z_1^{(3)} \\ \phi_{21} & \phi_{22} & \dots & \phi_{2J} & 1 & z_2^{(1)} & z_2^{(2)} & z_2^{(3)} \\ \vdots & \vdots & & \vdots & \vdots & \vdots & \vdots & \vdots \\ \phi_{J1} & \phi_{J2} & \dots & \phi_{JJ} & 1 & z_J^{(1)} & z_J^{(2)} & z_J^{(3)} \\ 1 & 1 & \dots & 1 & 0 & 0 & 0 & 0 \\ z_1^{(1)} & z_2^{(1)} & \dots & z_J^{(1)} & 0 & 0 & 0 & 0 \\ z_1^{(2)} & z_2^{(2)} & \dots & z_J^{(2)} & 0 & 0 & 0 & 0 \\ z_1^{(3)} & z_2^{(3)} & \dots & z_J^{(3)} & 0 & 0 & 0 & 0 \end{bmatrix} \begin{bmatrix} w_1 \\ w_2 \\ \vdots \\ w_J \\ p_0 \\ p_1 \\ p_2 \\ p_3 \end{bmatrix} = \begin{bmatrix} Zr_1 \\ Zr_2 \\ \vdots \\ Zr_J \\ 0 \\ 0 \\ 0 \\ 0 \end{bmatrix} \quad (6)$$

$$\begin{bmatrix} \phi_{11} & \phi_{12} & \dots & \phi_{1J} & 1 & z_1^{(1)} & z_1^{(2)} & z_1^{(3)} \\ \phi_{21} & \phi_{22} & \dots & \phi_{2J} & 1 & z_2^{(1)} & z_2^{(2)} & z_2^{(3)} \\ \vdots & \vdots & & \vdots & \vdots & \vdots & \vdots & \vdots \\ \phi_{J1} & \phi_{J2} & \dots & \phi_{JJ} & 1 & z_J^{(1)} & z_J^{(2)} & z_J^{(3)} \\ 1 & 1 & \dots & 1 & 0 & 0 & 0 & 0 \\ z_1^{(1)} & z_2^{(1)} & \dots & z_J^{(1)} & 0 & 0 & 0 & 0 \\ z_1^{(2)} & z_2^{(2)} & \dots & z_J^{(2)} & 0 & 0 & 0 & 0 \\ z_1^{(3)} & z_2^{(3)} & \dots & z_J^{(3)} & 0 & 0 & 0 & 0 \end{bmatrix} \begin{bmatrix} w_1 \\ w_2 \\ \vdots \\ w_J \\ p_0 \\ p_1 \\ p_2 \\ p_3 \end{bmatrix} = \begin{bmatrix} Zr_1 \\ Zr_2 \\ \vdots \\ Zr_J \\ 0 \\ 0 \\ 0 \\ 0 \end{bmatrix}$$

In the above equation, $\phi_{jk}$ represents $\phi(Z_j(t)-Z_K(t))$, and (f,t) and (t) are omitted.

A spectral transform surface is generated in expression (2) using estimated $W_k(f,t)$ and $p_m(f,t)$. Following that, upper and lower limits are defined for each frame to reduce the unnaturalness of singing synthesis and alleviate the influence caused when the user's singing is outside the timbre change tube. Abrupt changes are reduced by smoothing the time-frequency surface, thereby maintaining the spectral continuity. Finally, a synthesized audio signal for synthesized singing mimicking timbre changes of the input singing voice is obtained by transforming the spectral envelope for the audio signal of the reference singing voice using the spectral transform surface, and synthesizing the transformed audio signal with the technique called STRAIGHT.

With the steps described so far, singing synthesis mimicking timbre changes of the user's singing voice is accomplished. It is impossible, however, to go beyond the bounds of the user's singing representation merely by mimicking the user's singing. Then in order to expand the user's singing representation, it is preferably to provide an interface which enables manipulations of voice timbres based on estimation results. Preferably, such interface has the following three functions.

(1) To change the degree of voice timbre changes by scaling the voice timbre changes: the voice timbre changes can be scaled larger to synthesize a singing voice with emphasized timbre fluctuations or scaled smaller to synthesize a singing voice with suppressed timbre fluctuations.

(2) To change the center of timbre change by shifting the voice timbre changes: the center of voice timbre fluctuations can be changed to synthesize a singing voice around a particular voice timbre.

(3) Fine adjustment of the timbre changes is possible by partially applying the above-mentioned two functions.

In the present embodiment described so far, singing synthesis reflecting voice timbre changes is implemented using a plurality of singing voice sources of the same singer such as Hatsune Miku and Hatsune Miku Append. Further, singing synthesis may be capable of dynamically changing the voice quality by using constructing the timbre change tube with different singers. In the present embodiment, parameter estimation is not performed for existing singing synthesis systems. However, the timbre change tube may be applicable to the parameter estimation if the tube is constructed with a plurality of singers having different GEN parameters.

INDUSTRIAL APPLICABILITY

According to the present invention, it becomes possible for the first time to implement singing synthesis capable of estimating voice timbre changes from the input singing voice and mimicking the voice timbre changes of the input singing voice. The present invention allows the user to readily synthesize expressive human singing voices. Further, representative singing synthesis is possible in various viewpoints of pitch, dynamics, and voice timbre.

SIGN LISTING

1 Input singing voice audio signal storing section
3 Lyrics alignment section
5 Input singing voice audio signal analyzing section
7 Analysis data storing section
9 Pitch parameter estimating section
11 Dynamics parameter estimating section
13 Singing synthesis parameter data creating section
15 Lyrics data storing section
17 Off-pitch estimating section
19 Pitch correcting section
21 Pitch transposing section
23 Vibrato adjusting section
25 Smoothing section
101 Singing voice synthesizing section
103 Singing voice source database
105 Singing voice synthesis parameter data creating section
107 Synthesized singing voice audio signal storing section
109 Spectral envelope estimating section
111 Voice timbre space estimating section
113 Trajectory shifting and scaling section
115 First spectral transform curve estimating section
117 Second spectral transform curve estimating section
119 Spectral transform surface generating section
121 Synthesized audio signal generating section
123 Signal reproducing section

The invention claimed is:

1. A system for singing synthesis capable of reflecting voice timbre changes comprising:

a system for singing synthesis reflecting pitch and dynamics changes including:

an audio signal storing section operable to store an audio signal of an input singing voice;

a singing voice source database in which singing voice source data on K sorts of different singing voices, K being an integer of one or more, and singing voice source data on the same singing voice with J sorts of voice timbres, J being an integer of two or more, are accumulated;

a singing synthesis parameter data estimating section operable to estimate singing synthesis parameter data representing the audio signal of the input singing voice with a plurality of parameters including at least a pitch parameter and a dynamics parameter;

a singing synthesis parameter data storing section operable to store the singing synthesis parameter data;

a lyrics data storing section operable to store lyrics data corresponding to the audio signal of the input singing voice; and a singing voice synthesizing section operable to output an audio signal of a synthesized singing voice, based on at least the singing voice source data on one sort of singing voice selected from the singing voice source database, the singing synthesis parameter data, and the lyrics data;

a synthesized singing voice audio signal storing section operable to store audio signals of K sorts of different time-synchronized synthesized singing voices and audio signals of J sorts of time-synchronized synthesized singing voices of the same singer with different voice timbres;

a spectral envelope estimating section operable to apply frequency analysis to the audio signal of the input singing voice and the audio signals of K+J sorts of synthesized singing voices, and estimate, based on results of the frequency analysis of these audio signals, S spectral envelopes with influence of pitch ($F_0$) removed wherein S=K+J+1;

a voice timbre space estimating section operable to suppress components other than components contributing to voice timbre changes from a time sequence of the S spectral envelopes by means of processing based on a subspace method, and estimate an M-dimensional voice timbre space reflecting voice timbres of the input singing voice and the J sorts of voice timbres, M being an integer of one or more;

a trajectory shifting and scaling section operable to estimate, from the J spectral envelopes for the audio signals of the J sorts of different singing voices synthesized from the same singer's voice with different voice timbres, a positional relationship of the J sorts of voice timbres at each instant of time, which have been obtained by suppressing the components other than the components contributing to the voice timbre changes by means of the processing based on the subspace method, with M-dimensional vectors in the voice timbre space, and estimate a time trajectory of the positional relationship of the voice timbres estimated with the M-dimensional vectors as a timbre change tube in the voice timbre space; and further estimate from the spectral envelope for the audio signal of the input singing voice a positional relationship of the voice timbres of the input singing voice at each instant of time, which have been obtained by suppressing the components other than the components contributing to the voice timbre changes by means of the processing based on the subspace method, with M-dimensional vectors in the voice timbre space, and estimate a time trajectory of the positional relationship of the voice timbres of the input singing voice estimated with the M-dimensional vectors as a voice timbre trajectory of the input singing voice in the voice timbre space; and then shift or scale at least one of the voice timbre trajectory of the input singing voice and the timbre change tube such that the entirety or a major part of the voice timbre trajectory of the input singing voice is present inside the timbre change tube;

a first spectral transform curve estimating section operable to estimate J spectral transform curves for singing synthesis in correspondence with the J sorts of voice timbres by defining one of the J sorts of singing voice source data as reference singing voice source data, defining the spectral envelope for an audio signal of the synthesized singing voice corresponding to the reference singing voice source data as a reference spectral envelope, and calculating at each instant of time transform ratios of the J spectral envelopes for the audio signals of the J sorts of synthesized singing voices over the reference spectral envelope;

a second spectral transform curve estimating section operable to estimate a spectral transform curve corresponding to the voice timbre trajectory of the input singing voice at each instant of time so as to satisfy a constraint that when one point of the voice timbre trajectory of the input singing voice determined by the trajectory shifting and scaling section overlaps a certain voice timbre inside the timbre change tube at a certain instant of time, a spectral envelope for an audio signal of the input singing voice at the certain instant of time coincides with the spectral envelope of the synthesized singing voice with the overlapped voice timbre;

a spectral transform surface generating section operable to define a spectral transform surface at each instant of time by temporally concatenating all the spectral transform curves estimated by the second spectral transform curve estimating section; and a synthesized audio signal generating section operable to generate a transform spectral envelope at each instant of time by scaling the reference spectral envelope based on the spectral transform surface, and generate an audio signal of a synthesized singing voice reflecting voice timbre changes of the input singing voice, based on the transform spectral envelope and a fundamental frequency ($F_0$) contained in the reference singing voice source data.

2. The system for singing synthesis capable of reflecting voice timbre changes according to claim 1, wherein the spectral envelope estimating section is configured to:

normalize dynamics of S audio signals comprised of the audio signal of input singing voice, the audio signals of the K sorts of synthesized singing voices, and the audio signals of the J sorts of synthesized singing voices;

apply frequency analysis to the S normalized audio signals, and estimate a plurality of pitches and non-periodic components for a plurality of frequency spectra based on results of the frequency analysis;

determine whether a frame is voiced or unvoiced by comparing the estimated pitch with a threshold of periodicity score and estimate, for the voiced frames, envelopes for the plurality of frequency spectra in an $L_1$ dimension, $L_1$ being an integer of the power of 2 plus 1, based on fundamental frequencies of the audio signals and estimate, for the unvoiced frames, envelopes for the plurality of frequency spectra in the $L_1$ dimension based on a predetermined low frequency; and estimate the S spectral envelopes based on the plurality of frequency spectral envelopes for the voiced frames and the plurality of frequency spectral envelopes for the unvoiced frames.

3. The system for singing synthesis capable of reflecting voice timbre changes according to claim 2, wherein the trajectory shifting and scaling section is configured to place the entirety or a major part of the voice timbre trajectory of the input singing voice inside the timber change tube by:

shifting and scaling T×J M-dimensional principal component score vectors for the audio signals of the J sorts of synthesized singing voices, the T×J M-dimensional principal component score vectors forming the timbre change tube, such that the vectors are in the range of 0 to 1 in each dimension; and shifting and scaling T M-dimensional principal component score vectors for the audio signal of the input singing voice, the T M-dimensional principal component score vectors forming the voice timbre trajectory of the input singing voice, such that the vectors are in the range of 0 to 1 in each dimension.

4. The system for singing synthesis capable of reflecting voice timbre changes according to claim 1, wherein the voice timbre space estimating section is configured to:

apply discrete cosine transform to the S spectral envelopes to obtain S discrete cosine transform coefficients, and obtain S discrete cosine transform coefficient vectors up to low $L_2$ dimensions as targets of analysis in respect of the S spectral envelopes, the low $L_2$ dimensions excluding 0-dimension which is a DC component of the discrete cosine transform coefficient, wherein $L_2$ is a positive integer of $L_2<L_1$;

apply principal component analysis to the S $L_2$-dimensional discrete cosine transform coefficient vectors in each of T frames in which the S audio signals are voiced at the same instant of time wherein T is the number of seconds of duration of the audio signal×sampling period at a maximum, to obtain principal component coefficients and a cumulative contribution ratio for each of the S $L_2$-dimensional discrete cosine transform coefficient vectors;

convert the S discrete cosine transform coefficients into S $L_2$-dimensional principal component scores in the T frames by using the principal component coefficients;

obtain S N-dimensional principal component scores in respect of the S $L_2$-dimensional principal component scores by setting zero to principal component scores in dimensions higher than the low N-dimension in which a cumulative contribution ratio becomes R % wherein $0<R<100$ and N is an integer of $1\leq N\leq L_2$ as determined by R;

apply inverse transform to the S N-dimensional principal component scores to convert the scores into S new $L_2$-dimensional discrete cosine transform coefficients by using the corresponding principal component coefficients; and apply principal component analysis to T×S new $L_2$-dimensional discrete cosine transform coefficient vectors to obtain principal component coefficients and a cumulative contribution ratio for each of the T×S new $L_2$-dimensional discrete cosine transform coefficient vectors, convert the $L_2$-dimensional discrete cosine transform coefficients into principal component scores by using the obtained principal component coefficients, and define a space represented by the principal component scores up to M lowest dimensions as the voice timbre space wherein $1\leq M\leq L_2$.

5. The system for singing synthesis capable of reflecting voice timbre changes according to claim 4, wherein the trajectory shifting and scaling section is configured to place the entirety or a major part of the voice timbre trajectory of the input singing voice inside the timber change tube by:

shifting and scaling T×J M-dimensional principal component score vectors for the audio signals of the J sorts of synthesized singing voices, the T×J M-dimensional principal component score vectors forming the timbre change tube, such that the vectors are in the range of 0 to 1 in each dimension; and shifting and scaling T M-dimensional principal component score vectors for the audio signal of the input singing voice, the T M-dimensional principal component score vectors forming the voice timbre trajectory of the input singing voice, such that the vectors are in the range of 0 to 1 in each dimension.

6. The system for singing synthesis capable of reflecting voice timbre changes according to claim 1, wherein the trajectory shifting and scaling section is configured to place the entirety or a major part of the voice timbre trajectory of the input singing voice inside the timber change tube by:

shifting and scaling T×J M-dimensional principal component score vectors for the audio signals of the J sorts of synthesized singing voices, the T×J M-dimensional principal component score vectors forming the timbre change tube, such that the vectors are in the range of 0 to 1 in each dimension; and shifting and scaling T M-dimensional principal component score vectors for the audio signal of the input singing voice, the T M-dimensional principal component score vectors forming the voice timbre trajectory of the input singing voice, such that the vectors are in the range of 0 to 1 in each dimension.

7. The system for singing synthesis capable of reflecting voice timbre changes according to claim 1, wherein the second spectral transform curve estimating section has a function of thresholding the spectral transform curves at each instant of time corresponding to the voice timbre trajectory of the input singing voice by defining upper and lower limits for the spectral transform curves.

8. The system for singing synthesis capable of reflecting voice timbre changes according to claim 1, wherein the spectral transform surface generating section applies two-dimensional smoothing to the spectral transform surface.

9. A method for singing synthesis capable of reflecting voice timbre changes, the method being implemented in a computer and comprising:

a synthesized singing voice audio signal generating step of generating audio signals for K sorts of different time-synchronized synthesized singing voices, K being an inter of one or more, and audio signals for J sorts of time-synchronized synthesized singing voices of the same singer with different voice timbres, J being an integer of two or more, using a system for singing synthesis reflecting pitch and dynamics changes, the system including:

an audio signal storing section operable to store an audio signal of an input singing voice;

a singing voice source database in which singing voice source data on K sorts of different singing voices, and singing voice source data on the same singing voice with J sorts of voice timbres, are accumulated;

a singing synthesis parameter data estimating section operable to estimate singing synthesis parameter data representing the audio signal of the input singing voice with a plurality of parameters including at least a pitch parameter and a dynamics parameter;

a singing synthesis parameter data storing section operable to store the singing synthesis parameter data;

a lyrics data storing section operable to store lyrics data corresponding to the audio signal of the input singing voice; and a singing voice synthesizing section operable to output an audio signal of a synthesized singing voice, based on at least the singing voice source data on one sort of singing voice selected from the singing voice source database, the singing synthesis parameter data, and the lyrics data;

a spectral envelope estimating step of applying frequency analysis to the audio signal of the input singing voice and the audio signals of K+J sorts of synthesized singing voices, and estimating, based on results of the frequency analysis of these audio signals, S spectral envelopes with influence of pitch ($F_0$) removed wherein S=K+J+1;

a voice timbre space estimating step of suppressing components other than components contributing to voice timbre changes from a time sequence of the S spectral envelopes by means of processing based on a subspace method, and estimating an M-dimensional voice timbre space reflecting voice timbres of the input singing voice and the J sorts of voice timbres, M being an integer of one or more;

a trajectory shifting and scaling step of estimating, from the J spectral envelopes for the audio signals of the J sorts of different singing voices synthesized from the same singer's voice with different voice timbres, a positional relationship of the J sorts of voice timbres at each instant of time, which have been obtained by suppressing the components other than the components contributing to the voice timbre changes by means of the processing based on the subspace method, with M-dimensional vectors in the voice timbre space, and estimating a time trajectory of the positional relationship of the voice timbres estimated with the M-dimensional vectors as a timbre change tube in the voice timbre space; and further estimating from the spectral envelope for the audio signal of the input singing voice a positional relationship of the voice timbres of the input singing voice at each instant of time, which have been obtained by suppressing the components other than the components contributing to the voice timbre changes by means of the processing based on the subspace method, with M-dimensional vectors in the voice timbre space, and estimating a time trajectory of the positional relationship of the voice timbres of the input singing voice estimated with the M-dimensional vectors as a voice timbre trajectory of the input singing voice in the voice timbre space; and then shifting or scaling at least one of the voice timbre trajectory of the input singing voice and the timbre change tube such that the entirety or a major part of the voice timbre trajectory of the input singing voice is present inside the timbre change tube;

a first spectral transform curve estimating step of estimating J spectral transform curves for singing synthesis in correspondence with the J sorts of voice timbres by defining one of the J sorts of singing voice source data as reference singing voice source data, defining the spectral envelope for an audio signal of the synthesized singing voice corresponding to the reference singing voice source data as a reference spectral envelope, and calculating at each instant of time transform ratios of the J spectral envelopes for the audio signals of the J sorts of synthesized singing voices over the reference spectral envelope;

a second spectral transform curve estimating step of estimating a spectral transform curve corresponding to the voice timbre trajectory of the input singing voice at each instant of time so as to satisfy a constraint that when one point of the voice timbre trajectory of the input singing voice determined by the trajectory shifting and scaling section overlaps a certain voice timbre inside the timbre change tube at a certain instant of time, a spectral envelope for an audio signal of the input singing voice at the certain instant of time coincides with the spectral envelope of the synthesized singing voice with the overlapped voice timbre;

a spectral transform surface generating step of defining a spectral transform surface at each instant of time by temporally concatenating all the spectral transform curves estimated in the second spectral transform curve estimating step; and a synthesized audio signal generating step of generating a transform spectral envelope at each instant of time by scaling the reference spectral envelope based on the spectral transform surface, and generating an audio signal of a synthesized singing voice reflecting voice timbre changes of the input singing voice, based on the transform spectral envelope and a fundamental frequency ($F_0$) contained in the reference singing voice source data.

10. The method for singing synthesis capable of reflecting voice timbre changes according to claim 9, wherein in the spectral envelope estimating step:

dynamics of S audio signals are normalized, the S signals being comprised of the audio signal of input singing voice, the audio signals of the K sorts of synthesized singing voices, and the audio signals of the J sorts of synthesized singing voices;

frequency analysis is applied to the S normalized audio signals to estimate pitches and non-periodic components for a plurality of frequency spectra, based on results of the frequency analysis;

it is determined whether a frame is voiced or unvoiced by comparing the estimated pitch with a threshold of periodicity score, and envelopes for the plurality of frequency spectra are estimated in an $L_1$ dimension for the voiced frames, $L_1$ being an integer of the power of 2 plus 1, based on fundamental frequencies of the audio signals; and envelopes for the plurality of frequency spectra are estimated in the $L_1$ dimension for the unvoiced frames, based on a predetermined low frequency; and the S spectral envelopes are estimated based on the plurality of frequency spectral envelopes for the voiced frames and the plurality of frequency spectral envelopes for the unvoiced frames.

11. The method for singing synthesis capable of reflecting voice timbre changes according to claim 10, wherein in the trajectory shifting and scaling step, the entirety or a major part of the voice timbre trajectory of the input singing voice is placed inside the timber change tube by:

shifting and scaling T×J M-dimensional principal component score vectors for the audio signals of J-sorts of synthesized singing voices, the T×J M-dimensional principal component score vectors forming the timbre change tube, such that the vectors are in the range of 0 to 1 in each dimension; and shifting and scaling T M-dimensional principal component score vectors for the audio signal of the input singing voice, the T M-dimensional principal component score vectors forming the voice timbre trajectory of the input singing voice, such that the vectors are in the range of 0 to 1 in each dimension.

12. The method for singing synthesis capable of reflecting voice timbre changes according to claim 9, wherein in the voice timbre space estimating step:

discrete cosine transform is applied to the S spectral envelopes to obtain S discrete cosine transform coefficients, and S discrete cosine transform coefficient vectors are obtained up to low $L_2$ dimensions as targets of analysis in respect of the S spectral envelopes, the low $L_2$ dimensions excluding 0-dimension which is a DC component of the discrete cosine transform coefficient, wherein $L_2$ is a positive integer of $L_2<L_1$;

principal component analysis is applied to the S $L_2$-dimensional discrete cosine transform coefficient vectors in each of T frames in which the S audio signals are voiced at the same instant of time wherein T is the number of seconds of duration of the audio signal×sampling period at a maximum, to obtain principal component coefficients and a cumulative contribution ratio for each of the S $L_2$-dimensional discrete cosine transform coefficient vectors;

the S discrete cosine transform coefficients are converted into S $L_2$-dimensional principal component scores in the T frames by using the principal component coefficients;

S N-dimensional principal component scores are obtained in respect of the S $L_2$-dimensional principal component scores by setting zero to principal component scores in dimensions higher than the low N-dimension in which a cumulative contribution ratio becomes R % wherein $0<R<100$ and N is an integer of $1\leq N\leq L_2$ as determined by R;

inverse transform is applied to the S N-dimensional principal component scores to convert the scores into S new $L_2$-dimensional discrete cosine transform coefficients by using the corresponding principal component coefficients; and principal component analysis is applied to T×S new $L_2$-dimensional discrete cosine transform coefficient vectors to obtain principal component coefficients and a cumulative contribution ratio for each of the T×S new $L_2$-dimensional discrete cosine transform coefficient vectors, the $L_2$-dimensional discrete cosine transform coefficients are converted into principal component scores by using the obtained principal component coefficients, and a space represented by the principal component scores up to M lowest dimensions is defined as the voice timbre space wherein $1\leq M\leq L_2$.

13. The method for singing synthesis capable of reflecting voice timbre changes according to claim 12, wherein in the trajectory shifting and scaling step, the entirety or a major part of the voice timbre trajectory of the input singing voice is placed inside the timber change tube by:

shifting and scaling T×J M-dimensional principal component score vectors for the audio signals of J-sorts of synthesized singing voices, the T×J M-dimensional principal component score vectors forming the timbre change tube, such that the vectors are in the range of 0 to 1 in each dimension; and shifting and scaling T M-dimensional principal component score vectors for the audio signal of the input singing voice, the T M-dimensional principal component score vectors forming the voice timbre trajectory of the input singing voice, such that the vectors are in the range of 0 to 1 in each dimension.

14. The method for singing synthesis capable of reflecting voice timbre changes according to claim 9, wherein in the trajectory shifting and scaling step, the entirety or a major part of the voice timbre trajectory of the input singing voice is placed inside the timber change tube by:

shifting and scaling T×J M-dimensional principal component score vectors for the audio signals of J-sorts of synthesized singing voices, the T×J M-dimensional principal component score vectors forming the timbre change tube, such that the vectors are in the range of 0 to 1 in each dimension; and shifting and scaling T M-dimensional principal component score vectors for the audio signal of the input singing voice, the T M-dimensional principal component score vectors forming the voice timbre trajectory of the input singing voice, such that the vectors are in the range of 0 to 1 in each dimension.

* * * * *